US009199484B2

(12) United States Patent
Kodama et al.

(10) Patent No.: US 9,199,484 B2
(45) Date of Patent: Dec. 1, 2015

(54) RECORDING APPARATUS

(71) Applicant: SEIKO EPSON CORPORATION, Tokyo (JP)

(72) Inventors: Hidetoshi Kodama, Matsumoto (JP); Satoshi Chiba, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/219,844

(22) Filed: Mar. 19, 2014

(65) Prior Publication Data

US 2014/0292974 A1 Oct. 2, 2014

(30) Foreign Application Priority Data

Mar. 29, 2013 (JP) ..... 2013-071604

(51) Int. Cl.
*B41J 11/00* (2006.01)
*B41J 13/10* (2006.01)

(52) U.S. Cl.
CPC ..... *B41J 11/0005* (2013.01); *B41J 13/106* (2013.01)

(58) Field of Classification Search
CPC ..... B41J 11/0005; B41J 13/106
USPC ..... 347/101, 104; 271/188, 209
See application file for complete search history.

(56) References Cited

U.S. PATENT DOCUMENTS

| | | | | |
|---|---|---|---|---|
| 4,469,319 | A * | 9/1984 | Robb et al. | 271/3.05 |
| 2002/0051668 | A1* | 5/2002 | Kono | 400/582 |
| 2006/0170747 | A1* | 8/2006 | Yokouchi | 347/101 |
| 2014/0292978 | A1* | 10/2014 | Kodama et al. | 347/104 |

FOREIGN PATENT DOCUMENTS

| | | |
|---|---|---|
| JP | 2002-326755 | 11/2002 |
| JP | 2005-280214 | 10/2005 |
| JP | 2011-235494 | 11/2011 |

* cited by examiner

*Primary Examiner* — Manish S Shah
*Assistant Examiner* — Roger W Pisha, II
(74) *Attorney, Agent, or Firm* — Workman Nydegger

(57) ABSTRACT

A recording apparatus includes a discharge section that discharges a recording medium, a first bending member that is in contact with the recording medium and is transported toward the discharge section to bend the recording medium, a second bending member that is in contact with the recording medium on a further downstream side in a direction of the transport than a contact position of the discharge section, a mounting section where the recording medium that is discharged from the discharge section is mounted, and a first biasing member that is in contact with a surface on a rear end side in the transport direction of the recording medium mounted on the mounting section and on a side opposite to the recording surface to perform biasing toward a recording surface side on a further downstream side than the contact position of the discharge section.

8 Claims, 10 Drawing Sheets

RECORDING APPARATUS

BACKGROUND

1. Technical Field

The present invention relates to a recording apparatus in which recording is performed on a recording medium by using a liquid such as ink and, more particularly, to parts that transport and discharge the recording medium on which recording is performed.

In the present application, ink jet type serial printers, line printers, copiers, fax machines and the like are included in the recording apparatus.

2. Incorporated by Reference

The entire disclosure of Japanese Patent Application No. 2013-071604, filed Mar. 29, 2013 is expressly incorporated by reference herein.

3. Related Art

In the related art, ink jet type recording apparatuses are in wide use as this type of recording apparatus. JP-A-2002-326755, JP-A-2005-280214, and JP-A-2011-235494 are examples of the related art. In JP-A-2002-326755, a face-up type structure is used in a part of the ink jet type recording apparatus (hereinafter referred to as "printer") that discharges the recording medium. In JP-A-2005-280214 and JP-A-2011-235494, face-down type structures are used in parts of the printers that discharge the recording medium.

In the face-up type, the recording medium is discharged to a mounting section in such a manner that a recording surface of the recording medium that is discharged from a discharge section is directed toward the side opposite to a mounting surface of the mounting section where the recording medium is mounted. In the face-down type, the recording medium is discharged to the mounting section in such a manner that a recording surface of the recording medium is directed toward the mounting surface.

In the face-up type printer, when successive printing is performed on a plurality of sheets of the recording medium, tip end sides of the second and subsequent sheets of the recording medium in a transport direction are transported while being in contact with the recording surface of the recording medium which is already discharged to the mounting section and are mounted on the mounting section. Accordingly, deterioration such as unfixed recording contents and images may be generated on the recording surface in a case where ink attached to the recording surface is in a state of not being fixed on the recording surface.

Further, the second and subsequent sheets of the recording medium that are in contact with the recording surface may be contaminated and recording quality may be decreased by the ink which is attached to the tip end sides.

Such problems become further significant due to an increase in recording speed.

Accordingly, in the printer of JP-A-2002-326755, flexibility is added by bending a part of the recording medium so that the tip end side of the recording medium in the transport direction is transported in a non-contact state on the recording surface of the recording medium which is mounted on the mounting section when the recording medium is discharged to the mounting section, is transported to a position substantially right above the recording surface, and then falls to discharge the recording medium to the mounting section.

In this printer, a plurality of discharge rollers are disposed in a width direction crossing the transport direction of the recording medium. In the plurality of discharge rollers, the diameter of the discharge roller that is positioned in a central portion in the width direction is set to be smaller than the diameter of the discharge roller that is positioned on an end section side in the width direction. Also, the coefficient of friction of a surface of the discharge roller that is positioned in the central portion is set to be larger than the coefficient of friction of a surface of the discharge roller that is positioned on the end section side so that a transporting force with respect to the recording medium is uniform in an axial direction of the discharge roller.

In the ink jet type recording apparatus, the recording surface is expanded by absorbing ink drops when the ink drops are attached to the recording surface of the recording medium. When the recording medium is discharged from the discharge section and restriction by a discharge mechanism is released, the recording medium is reversed by the expansion in such a manner that the surface (surface where the ink is not discharged) opposite to the recording surface becomes an inner side, and a left side edge portion and a right side edge portion of the recording medium or a leading edge portion and a trailing edge portion in a front view in the transport direction are curled and deformed. The curling problem also becomes further significant due to an increase in recording speed.

Whether the left side edge portion and the right side edge portion of the recording medium are curled or the leading edge portion and the trailing edge portion of the recording medium are curled depends on the type of the recording medium.

In the printer of JP-A-2002-326755, the recording medium is bent by a plurality of the discharge rollers having different diameters in such a manner that the central portion of the recording surface in the front view in the transport direction is a concave surface more recessed than the left side edge portion and the right side edge portion. The flexibility of the recording medium can be strengthened in the transport direction by forming a recessed surface bending shape (substantially U shape) where the recording surface is the inner side.

However, when the tip end side of the recording medium is separated from the discharge roller and is transported toward the mounting section, a restricting force of the discharge roller does not act on the tip end side of the recording medium and a free state results therefrom. Also, in this case, the ink drops that are attached to the recording surface are not completely dried. Accordingly, a force to expand and curl the recording medium continues to act on the recording medium. As a result, the recording medium may be curled from the tip end side of the recording medium that is discharged from the discharge section. As a result, the recording medium is mounted on the mounting section in a curled state.

When the next or subsequent recording medium is transported to the mounting section in this state, the recording medium collides with the recording medium that is mounted in the curled state or is piled up on the curled recording medium to block a transport path of the recording medium on a downstream side of the discharge roller. In this manner, jamming may occur in the transport path. Also, when the curled recording medium is piled up on the mounting section, the recording-completed recording medium is forced out of the device without being fully mounted on the mounting section, and thus the recording medium may not be appropriately mounted on the mounting section.

Also, in the face-down type printers of JP-A-2005-280214 and JP-A-2011-235494, the recording medium that is discharged is bent into a substantially U shape with the recording surface being an inner side, that is, a recessed surface and discharge is made in a discharge port section on a downstream side of the discharge roller.

The printer of JP-A-2005-280214 performs recording by forming a regularly wavy shape (cockling) in the width direction of the recording medium crossing the transport direction so as to maintain recording quality of the recording unit. Then, the recording medium is bent into a substantially U shape and is discharged by a stack lever disposed in the discharge port section with the recording surface inside.

Also, in the printer of JP-A-2011-235494, a medium guide is disposed at positions corresponding to both of the end sections of the recording medium in the width direction crossing the transport direction in the discharge port section on a downstream side of the discharge roller. The recording medium is bent into a substantially U shape by the medium guide and is discharged.

However, in the printers of JP-A-2005-280214 and JP-A-2011-235494, the bending shape is formed by causing a bending member which is disposed in the discharge port section and the recording medium to abut against each other. Accordingly, the abutting state between the bending member and the recording medium is released when the recording medium is transported to the mounting section after the bending shape is formed in the recording medium. As such, a force to curl the recording medium acts on the recording medium that is transported to the mounting section. As a result, curling may be generated in the recording medium to return the recording medium from the bent state to an original flat state.

Accordingly, when the next or subsequent recording medium is transported to the mounting section in a state where the recording medium in the curled state is mounted on the mounting section, the recording medium collides with the recording medium that is mounted in the curled state or is piled up on the curled recording medium.

In this manner, the curled recording medium is piled up on the mounting section, the recording-completed recording medium is forced out of the device without being fully mounted on the mounting section, and thus the recording medium may not be appropriately mounted on the mounting section.

SUMMARY

An advantage of some aspects of the invention is to provide a recording apparatus that is capable of preventing curling of a recording medium that is discharged from a discharge section and appropriately mounting the recording medium on a mounting section.

A recording apparatus according to an aspect of the invention includes a recording unit that performs recording on a recording surface of a recording medium, a discharge section that discharges the recording medium which is transported from the recording unit along a transport path, a first bending member that is in contact with the recording medium which passes through the recording unit in the transport path and is transported toward the discharge section to bend the recording medium, a second bending member that is in contact with the recording medium on a further downstream side in a direction of the transport than a contact position of the discharge section where a feeding force is applied to the recording medium and maintains a bending shape of the recording medium which is bent by the first bending member as it is, a mounting section where the recording medium that is discharged from the discharge section is mounted, and a first biasing member that is in contact with a surface on a rear end side in the transport direction of the recording medium mounted on the mounting section and on a side opposite to the recording surface to perform biasing toward a recording surface side on a further downstream side in the transport direction of the recording medium than the contact position of the discharge section, in which the first biasing member has mobility.

The mobility means that the first biasing member may be configured to be capable of moving about a rotating shaft fulcrum or the first biasing member may be configured to be capable of moving by sliding in a moving shaft. It is preferable that at least a part be configured as a flexible member because design at a low cost is possible. In a case where the first biasing member is a rigid member capable of moving about the rotating shaft fulcrum or the first biasing member is configured to be capable of moving by sliding in the moving shaft, the first biasing member is disposed in a portion that can be touched by a user, but it is possible to prevent accidental damage to the first biasing member caused by the user.

According to the recording apparatus, the recording medium that is discharged from the discharge section to the mounting section is in contact with the first biasing member, moves the first biasing member, and is transported to and mounted on the mounting section in a state of being bent or both thereof being performed. Accordingly, an elastic force is generated in the first biasing member due to the movement and the bending, and the rear end side of the recording medium in the transport direction is biased by the elastic force.

In this manner, the first biasing member, when in contact with the recording medium that passes through the second bending member and is transported, is moved following the bending shape of the recording medium which is bent by the first bending member and the second bending member, bending or both thereof are performed, and is in contact with the recording medium.

Accordingly, the first biasing member follows the bending shape, the contact between the first biasing member and the recording medium is stabilized, the first biasing member maintains the bending shape of the recording medium by the above-described contact, and the holding force inhibits the returning from the bending shape to the original flat shape. In this manner, the shape bent by the first bending member can be maintained as it is in the recording medium while the recording medium is mounted on the mounting section. Further, a plurality of sheets of the recording medium can be mounted appropriately on the mounting section.

In this specification, the meaning of the second bending member "maintaining the shape as it is" is not limited to completely maintaining the shape of the recording medium bent by the first bending member as it is. Instead, in a case where the bending shape is a U-shaped curl, the bending angle, the bending amount, and the like are allowed to be changed or, in a case where the bending shape is a wavy shape (cockling), wavy points, the number of waves, and the like are allowed to be changed. In other words, the meaning includes a change insofar as a significance of the shape of the recording medium bent by the first bending member is not lost.

Also, the "flexibility" that is a type of the mobility in this specification is different from a member rotating with the rotating shaft as a fulcrum, and means that the member itself is bent and deformed. In other words, the "flexibility" means being designed in such a manner that the shape thereof is deformed and bent in the direction of the pressing force while resisting the pressing force in a state of abutting against the transported recording medium, receiving the pressing force resulting from the abutting from the recording medium.

When it comes to the "recording surface," the "recording surface" corresponds to both of the surfaces in a case where images are recorded on both of the surfaces of the recording medium. However, it is preferable to refer to the surface where the final recording is performed as the "recording surface."

The recording apparatus may further include a second biasing member that is in contact with a surface on a tip end side in the transport direction of the recording medium mounted on the mounting section and on a side opposite to the recording surface to perform biasing toward the recording surface side on a further downstream side of a position of the first biasing member which is in contact with the recording medium, in which the second biasing member may have mobility.

The mobility means that the second biasing member may be configured to be capable of moving about the rotating shaft fulcrum or the second biasing member may be configured to be capable of moving by sliding in the moving shaft. It is preferable that at least a part be configured as a flexible member because design at a low cost is possible. In a case where the second biasing member is a rigid member capable of moving about the rotating shaft fulcrum or the second biasing member is configured to be capable of moving by sliding in the moving shaft, the second biasing member is disposed in a portion that can be touched by a user, but it is possible to prevent accidental damage to the second biasing member caused by the user.

According to the recording apparatus, the recording medium that is discharged from the discharge section is in contact with the second biasing member, moves the second biasing member, and is transported to and mounted on the mounting section in a state of being bent or both thereof being performed. Accordingly, an elastic force is generated in the second biasing member due to the movement and the bending, and the tip end side of the recording medium in the transport direction is biased by the elastic force.

In this manner, the second biasing member, when in contact with the recording medium that passes through the second bending member and the first biasing member and is transported, is moved following the bending shape of the recording medium which is bent by the first bending member and the second bending member, bending or both thereof are performed, and is in contact with the recording medium.

Further, the rear end side of the recording medium in the transport direction is biased by the first biasing member, and thus the shape of the recording medium bent by the first bending member can be maintained as it is by the first biasing member and the second biasing member while the recording medium is mounted on the mounting section.

Accordingly, the curling of the recording medium to the side opposite to the recording surface can be suppressed or prevented. As a result, the recording medium can be held in a state where the bending shape is maintained, and thus a plurality of sheets of the recording medium can be stacked and mounted appropriately.

In the recording apparatus, the position of the first biasing member that is in contact with the recording medium may be on an outer side than the position of the second biasing member that is in contact with the recording medium in a width direction of the mounting section crossing the transport direction.

According to the recording apparatus, the position of the first biasing member biasing the rear end side of the recording medium that is in contact with the recording medium is positioned on an outer side than the position of the second biasing member that is in contact with the recording medium. In the "outer side" arrangement, in a case where the recording medium is curled along the transport direction (so-called vertical curl), curling may be initiated on the tip end side if the length of the recording medium in the transport direction is long even when the recording medium is pressed by the first biasing member. However, it is preferable that the second biasing member be arranged on an inner side than the first biasing member. It is preferable that the first biasing member be arranged as close as possible to both of the end sides of the recording medium so as to strongly suppress the curling of the recording medium and the second biasing member be positioned on an inner side than the first biasing member so as to correspond to many types of recording media.

In the recording apparatus, a convex-shaped section may be disposed in a central portion of the mounting section in a width direction of the recording medium, and the convex-shaped section may correspond to the shape of the recording medium discharged from the discharge roller which is bent by the first bending member.

Herein, to "correspond to the shape which is bent" means a configuration in which the bending shape can be maintained in contact in a fitted shape with the bending shape of the recording medium. For example, a convex shape uniformly fitting to an inner portion of the U shape thereof corresponds to a case where the recording medium is bent in a U shape along the transport direction.

According to the recording apparatus, a shape maintaining function by the convex-shaped section is added in addition to a shape maintaining function of the second bending member, and the shape bent by the first bending member can be further effectively maintained as it is.

In other words, when the recording medium is mounted, abutting against the central portion of the recording medium which is bent in the transport direction is made. In this manner, the convex-shaped section acts to inhibit the displacement of the central portion of the recording medium in the direction crossing the recording surface even when the recording medium which is mounted on the mounting section is to return from the bending shape to the original flat state. Accordingly, the convex-shaped section can maintain the bending shape of the recording medium.

Also, according to the recording apparatus, the tip end side of the recording medium and the convex-shaped section are in contact with each other in the mounting section, and the recording medium is sent to the mounting section and is mounted by the discharge roller in a state where the other portion of the recording medium is not in contact with the convex-shaped section. In this case, the tip end side of the recording medium is transported while abutting against the convex-shaped section, and the frictional force is generated between the tip end side and the convex-shaped section.

The frictional force acts in the direction opposite to the transport direction to press the tip end side of the recording medium to the convex-shaped section, and thus the curling of the tip end side of the recording medium to the side opposite to the recording surface can be suppressed. In this manner, the convex-shaped section can maintain the shape of the recording medium bent by the first bending member as it is with the second bending member.

In the recording apparatus, the first bending member may bend the recording medium in such a manner that the recording surface is directed inside by displacing both side portions with respect to a central portion of the recording medium in a width direction of the recording medium at a position on a further upstream side in the transport direction of the recording medium in the transport direction than the contact position of the discharge section where the feeding force is applied to the recording medium.

According to the above-described configuration, the first bending member displaces both of the side portions of the transported recording medium with respect to the central portion at a position on a further upstream side than the contact positions of the discharge section, and bends the recording medium in such a manner that the recording surface is directed inside.

In this manner, the transported recording medium is bent by the first bending member first at a position on a further upstream side than the discharge section, and is discharged by receiving the feeding force from the discharge section in the bending shape on a further downstream side than the first bending member. In this manner, the flexibility of the recording medium can be strengthened in the transport direction of the recording medium and the width direction crossing the transport direction.

Accordingly, both the curling in the transport direction and the curling in the width direction crossing the transport direction can be suppressed in the recording medium which is transported in a discharge direction from the discharge section.

In the recording apparatus, the first biasing member may be configured to be rotatable.

The first biasing member is configured to be rotatable, and thus the first biasing member abuts against the recording medium and is rotated when the recording medium is transported to the mounting section. Accordingly, the transport of the recording medium toward the mounting section is not hindered. Further, the first biasing member returns from a rotating state to an original state when the recording medium is mounted on the mounting section, and the recording medium is biased from above the recording medium. Accordingly, the first biasing member can suppress or prevent the curling of the recording medium to the side opposite to the recording surface, that is, upward.

In the recording apparatus, the discharge section may include a discharge roller that is positioned in a central portion of the transport path in a width direction of the recording medium which is transported, the first bending member may include a first deformation member that is in contact with the recording medium on an upstream side in the transport direction with respect to the contact position of the discharge roller where the feeding force is applied to the recording medium and at both outer side positions in the width direction with respect to the contact position of the discharge roller, and a second deformation member that is in contact with the recording medium on an upstream side in the transport direction with respect to a position of the first deformation member in contact with the recording medium and at both outer side positions in the width direction with respect to the contact position of the first deformation member, and first-stage bending of the recording medium that is transported may be performed as the recording medium abuts against the second deformation member and second-stage bending may be performed as the recording medium abuts against the first deformation member, and an amount of the second-stage bending may be larger than an amount of the first-stage bending.

According to the recording apparatus, the discharge roller is in contact with the central portion of the transported recording medium in the width direction. Further, the first deformation member is in contact with the recording medium on an upstream side with respect to the contact position of the discharge roller and at both of the outer side positions with respect to the contact position of the discharge roller positioned in the central portion in the width direction. The above-described three-point contact structure causes the bending shape to be formed in such a manner that the recording surface of the recording medium is directed inside.

The above-described three-point contact structure is configured to have the discharge roller that corresponds to an apex angle position of a triangle and a pair of the first deformation members that correspond to base angle positions of the triangle. Further, the first deformation member is configured to be in contact with the transported recording medium at a position shifted to the bent side with respect to a reference plane based on the plane through the contact position of the discharge roller toward the recording medium and along the transport surface of the transport path.

In other words, a contact point where the discharge roller is in contact with the recording medium P and contact points where the pair of first deformation members are in contact with the recording medium are shifted with respect to the transport direction and with respect to the direction crossing the reference plane (direction crossing the transport surface of the transport path).

Referring to the above-described contact structure based on the shifted contact points as a three-dimensional contact structure according to this aspect, the three-dimensional contact structure allows the flexibility of the recording medium to be further strengthened in the transport direction of the recording medium and in the width direction crossing the transport direction. Accordingly, both the curling in the transport direction and the curling in the width direction crossing the transport direction can be further suppressed in the recording medium which is transported in the discharge direction from the discharge section.

Also, in the transport path, the second deformation member is in contact with the recording medium on an upstream side with respect to the contact position where the first deformation member is in contact with the recording medium and at both of the outer side contact positions in the width direction. In this manner, the bending of the recording medium can be initiated (first-stage bending) by the second deformation member from both of outer side portions which are far from the central portion of the recording medium, and then the bending can be in progress (second-stage bending) by the first deformation member on a side closer to the central portion than to the second deformation member, that is, at inner-side positions.

In other words, the bending of the recording medium can be divided into a plurality of times and performed phase by phase. In this manner, the recording medium can be bent by reasonably displacing both of the side portions with respect to the central portion.

Also, the amount of the second-stage bending (by the first deformation member) is larger than the amount of the first-stage bending (by the second deformation member), and thus the amount of displacement (bending angle) of both of the side portions of the recording medium with respect to the central portion is changed from a small displacement amount (small bending angle) to a large displacement amount (large bending angle).

In this manner, the displacement of both of the side portions of the recording medium with respect to the central portion can be reasonably increased, and the flexibility can be reasonably strengthened. Accordingly, a force to curl the recording medium can be resisted, and the curling of the recording medium can be suppressed and prevented.

In the recording apparatus, the recording unit may include a line type recording head.

An effect of the invention is significant when the invention is applied to a line printer with high recording speed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
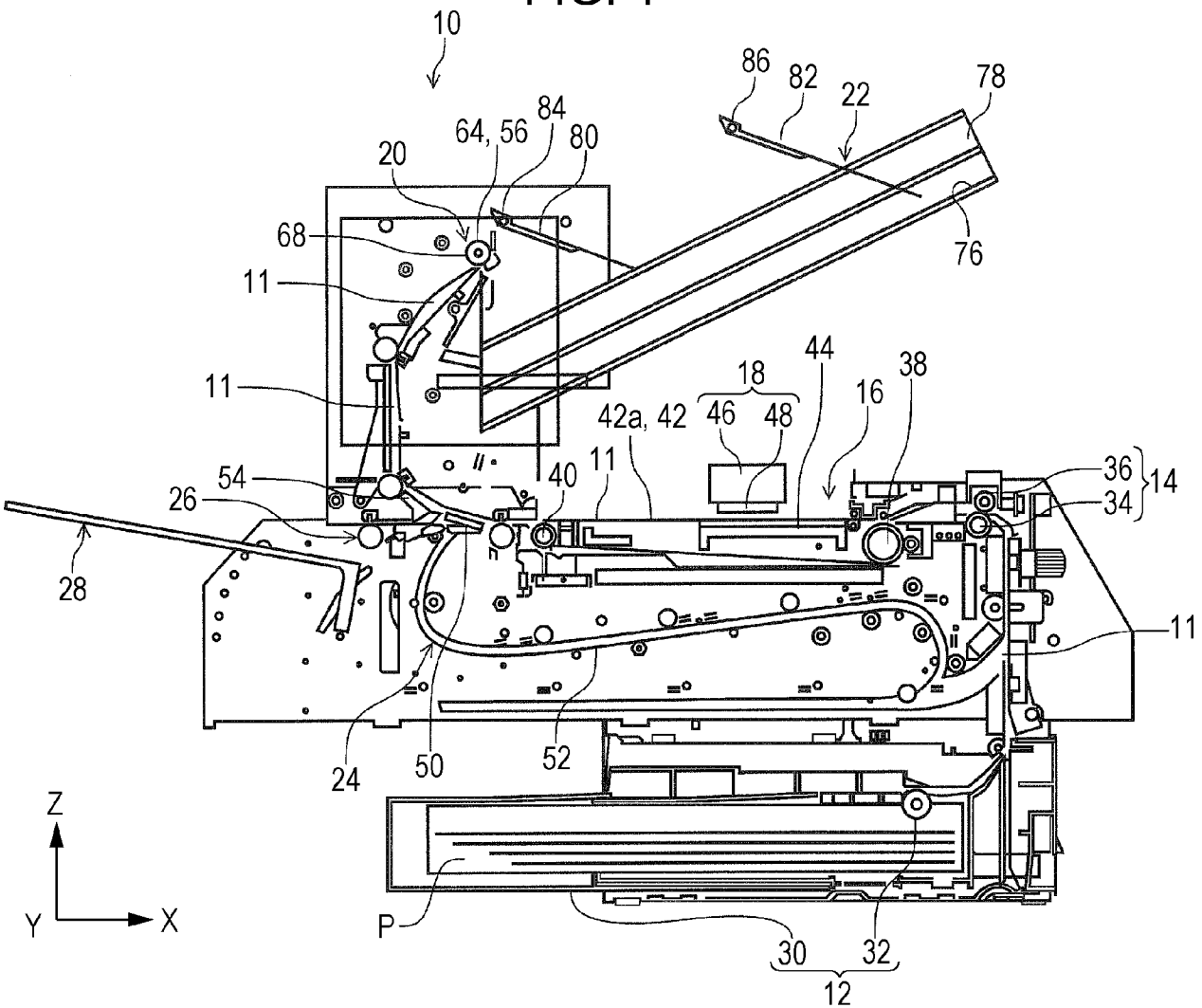
FIG. 1 is a side cross-sectional view showing a sheet transport path of a recording apparatus according to an embodiment of the invention.

In an X-Y-Z coordinate system shown in each of the drawings, an X direction shows a length direction of a recording medium, a Y direction shows a width direction of the recording medium in a transport path in a recording apparatus, and a Z direction shows a device height direction.

Hereinafter, an overall configuration of a recording apparatus 10 according to an embodiment of the invention will be described with reference to FIG. 1. One example of the recording apparatus 10 is a line type ink jet printer that is capable of high-speed and high-density printing. The recording apparatus 10 includes a feeding unit 12 that accommodates a recording medium P such as a sheet, a transport unit 14, a belt transport unit 16, a recording unit 18, a Fd (face-down) discharge section 20 as a "discharge section," a Fd (face-down) mounting section 22 as a "mounting section," a reverse path section 24 as a "reverse transport mechanism," a Fu (face-up) discharge section 26, and a Fu (face-up) mounting section 28.

The feeding unit 12 is arranged in a lower portion of the recording apparatus 10. The feeding unit 12 has a feeding tray 30 that accommodates the recording medium P, and a feed roller 32 that sends the recording medium P which is accommodated in the feeding tray 30 to a transport path 11.

The recording medium P that is accommodated in the feeding tray 30 is fed to the transport unit 14 along the transport path 11 by the feed roller 32. The transport unit 14 has a transport driving roller 34 and a transport driven roller 36. The transport driving roller 34 is rotation-driven by a driving source (not shown). In the transport unit 14, the recording medium P is pinched (nipped) between the transport driving roller 34 and the transport driven roller 36 and is transported to the belt transport unit 16 that is positioned on a downstream side of the transport path 11.

The belt transport unit 16 has a first roller 38 that is positioned on an upstream side of the transport path 11, a second roller 40 that is positioned on a downstream side, an endless belt 42 that is mounted on the first roller 38 and the second roller 40 in a rotationally movable manner, and a supporting body 44 that supports an upper side section 42*a* of the endless belt 42 between the first roller 38 and the second roller 40.

The endless belt 42 is driven to be moved from a +X direction to a −X direction in the upper side section 42*a* by the first roller 38 or the second roller 40 driven by a driving source (not shown). Accordingly, the recording medium P that is transported from the transport unit 14 is further transported to a downstream side of the transport path 11 in the belt transport unit 16.

The recording unit 18 has a line type recording head 48 and a head holder 46 that holds the line type recording head 48. The recording unit 18 may be a serial type recording unit in which a recording head is disposed in a carriage reciprocating in a Y-axis direction. The recording head 48 is arranged to face the upper side section 42*a* of the endless belt 42 that is supported by the supporting body 44. The recording head 48 discharges ink toward the recording medium P and performs recording when the recording medium P is transported in the upper side section 42*a* of the endless belt 42. The recording medium P is transported to a downstream side of the transport path 11 by the belt transport unit 16 while the recording is performed.

Also, the "line type recording head" is a head used in a recording apparatus with a nozzle area that is formed in a direction crossing a transport direction of the recording medium P disposed to be capable of covering the entire crossing direction of the recording medium P and forming an image by fixing one of the head and the recording medium P and moving the other one of the head and the recording medium P. The crossing-direction nozzle area of the line head may not be capable of covering the entire crossing direction of the entire recording medium P to which the recording apparatus corresponds.

Also, a first branch section 50 is disposed on a downstream side of the transport path 11 in the belt transport unit 16. The first branch section 50 is configured to be switchable between the transport path 11 that transports the recording medium P to the Fd discharge section 20 or the Fu discharge section 26 and a reverse path 52 of the reverse path section 24 that reverses a recording surface of the recording medium P and transports the recording medium P back to the recording unit 18. The recording surface of the recording medium P that is switched to the reverse path 52 by the first branch section 50 and transported is reversed during a transport process in the reverse path 52, and the recording medium P is transported back to the recording unit 18 in such a manner that the surface on the side opposite to the initial recording surface faces the recording head 48.

A second branch section 54 is also disposed on a downstream side of the first branch section 50 along the transport path 11. The second branch section 54 is configured to be capable of switching the transport direction of the recording medium P so that the recording medium P is transported toward the Fd discharge section 20 or the recording medium P is transported toward the Fu discharge section 26.

The recording medium P that is transported toward the Fd discharge section 20 in the second branch section 54 is discharged from the Fd discharge section 20 and is mounted on the Fd mounting section 22. In this case, the recording surface of the recording medium P is mounted to face the Fd mounting section 22. Also, the recording medium P that is transported toward the Fu discharge section 26 in the second branch section 54 is discharged from the Fu discharge section 26 and is mounted on the Fu mounting section 28. In this case, the recording surface of the recording medium P is mounted to be directed to the side opposite to the Fu mounting section 28.

First Embodiment

Next, structures of the Fd discharge section 20 as the "discharge section," the Fd mounting section 22 as the "mounting section," and the like of the recording apparatus according to the first embodiment will be described in order with reference to FIGS. 2 to 5.

Discharge Section

The Fd discharge section 20 has a plurality of discharge rollers 56, and first bending members 58 are disposed on a further upstream side of the transport direction than nip positions 70 (described later) of the discharge rollers 56 in the transport path 11. In this embodiment, the first bending member 58 has a first deformation member 60 and a second deformation member 62. The first bending member 58 can also be configured to have only the first deformation member 60.

The plurality of discharge rollers 56 have discharge driving rollers 64 and discharge driven rollers 66 that form pairs.

A plurality of the discharge driving rollers 64 are disposed in a driving shaft 68 at predetermined intervals. The discharge driving rollers 64 are rotation-driven by the driving shaft 68 that is driven by a driving source (not shown). Also, the discharge driving rollers 64 are arranged at positions corresponding to a central portion of the recording medium P in the direction crossing the transport direction, that is, in the width direction (Y-axis direction in FIG. 5) of the recording medium P which is transported on a transport surface of the transport path 11.

Also, the discharge driven rollers 66 are configured as toothed rollers that are in point contact with the recording medium P, and are biased toward the discharge driving rollers 64. Further, the discharge driving rollers 64 and the discharge driven rollers 66 are in contact with the recording medium P at the nip positions 70 (refer to FIG. 5) and apply a feeding force to the recording medium P. In this specification, the "nip position" may be referred to as a "contact position" of the discharge roller 56 as a position where the discharge roller 56 is in contact with the recording medium P to apply the feeding force.

First Bending Member

In this embodiment, the first bending member 58 is a rigid member.

Herein, the "rigid member" is used to mean a member with a property contrary to "flexibility." However, the property contrary to "flexibility" does not strictly mean that the member is not bendable at all. Instead, in this specification, the "rigid member" means a member whose original shape is substantially maintained.

The first bending member 58 is a rigid member, and thus the first bending member 58 can bend the recording medium P without being bent when abutting against the recording medium P. Also, the first bending member 58 is not bent when bending the recording medium P, and thus can resist a reaction force against the bending which is generated in the recording medium P when the recording medium P is bent and can maintain a bending shape thereof. Also, the recording medium P can be sent downstream in a bent state, and thus flexibility of the recording medium P can be strengthened even in a state where the recording medium P is sent and separated from the nip positions 70 of the discharge rollers 56. Accordingly, curling of a tip end side of the recording medium P on the axis of the width direction crossing the transport direction can be suppressed when the recording medium P is separated from the discharge rollers 56.

In particular, the first bending member 58 transfers the recording medium P to a second bending member (described later) in a state where the recording medium P is bent, and thus it is necessary to bend the recording medium P as strongly as possible. If the bending is insufficient, a transport error may be caused during the transfer or the recording medium P may not be mounted appropriately on the mounting section 22 with the second bending member 74 not functioning as desired. Accordingly, it is preferable that a rigid member be used as the first bending member 58 so that the bending is somewhat strong.

Next, a structure of the first bending member 58 of this embodiment will be described in detail.

The first bending member 58 displaces both side portions Ps with respect to a central portion Pc of the recording medium P in the width direction (Y-axis direction in FIG. 5) of the recording medium P at a position on a further upstream side in the transport direction (X-axis direction in FIG. 5) than the contact positions (nip positions) 70 of the Fd discharge section 20 that apply the feeding force to the recording medium P, and the recording medium P is bent in such a manner that the recording surface is directed inside.

The first deformation member 60 and the second deformation member 62 of the first bending member 58 are disposed in a frame 72 (refer to FIGS. 4 and 5) that constitutes one of components of the Fd discharge section 20 and the transport path 11. The first deformation member 60 is arranged in such a manner that a position 13 in contact with the recording medium P is a position of a distance L1 from the nip positions 70 of the discharge rollers 56 on an upstream side (−X direction) of the transport path 11 in the transport direction (X-axis direction in FIG. 5).

In this embodiment, it is preferable that the distance L1 be 15 mm or less. Further preferably, the distance L1 is 3 mm to 6 mm.

Figure 5:
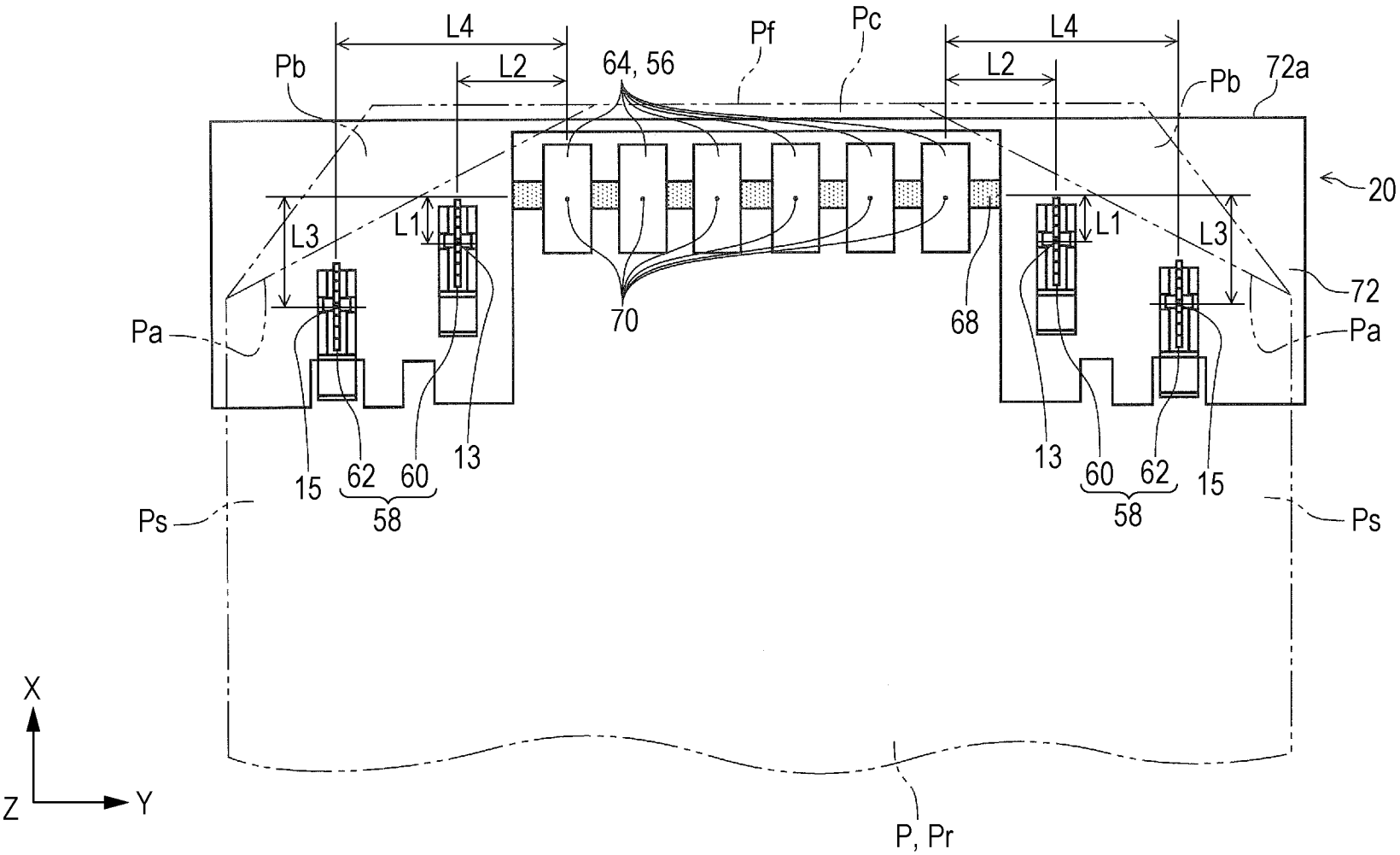
FIG. 5 is a bottom view showing a relationship between a discharge roller and a first bending member in the discharge section of the recording apparatus according to the embodiment of the invention.

Also, the first deformation member 60 is arranged in such a manner that the contact position 13 is a position of a distance L2 from the endmost nip position 70 outside an area of the nip positions 70 of the discharge rollers 56 in the width direction (Y-axis direction in FIG. 5) crossing the transport direction (X-axis direction in FIG. 5).

In this embodiment, it is preferable that the distance L2 be 80 mm or less considering damage to the recording medium P and biasing of the recording medium P. More preferably, the distance L2 is 5 mm to 70 mm. Even more preferably, the distance L2 is 15 mm to 70 mm. In this embodiment, the distance L2 is set to 20 mm.

Figure 4:
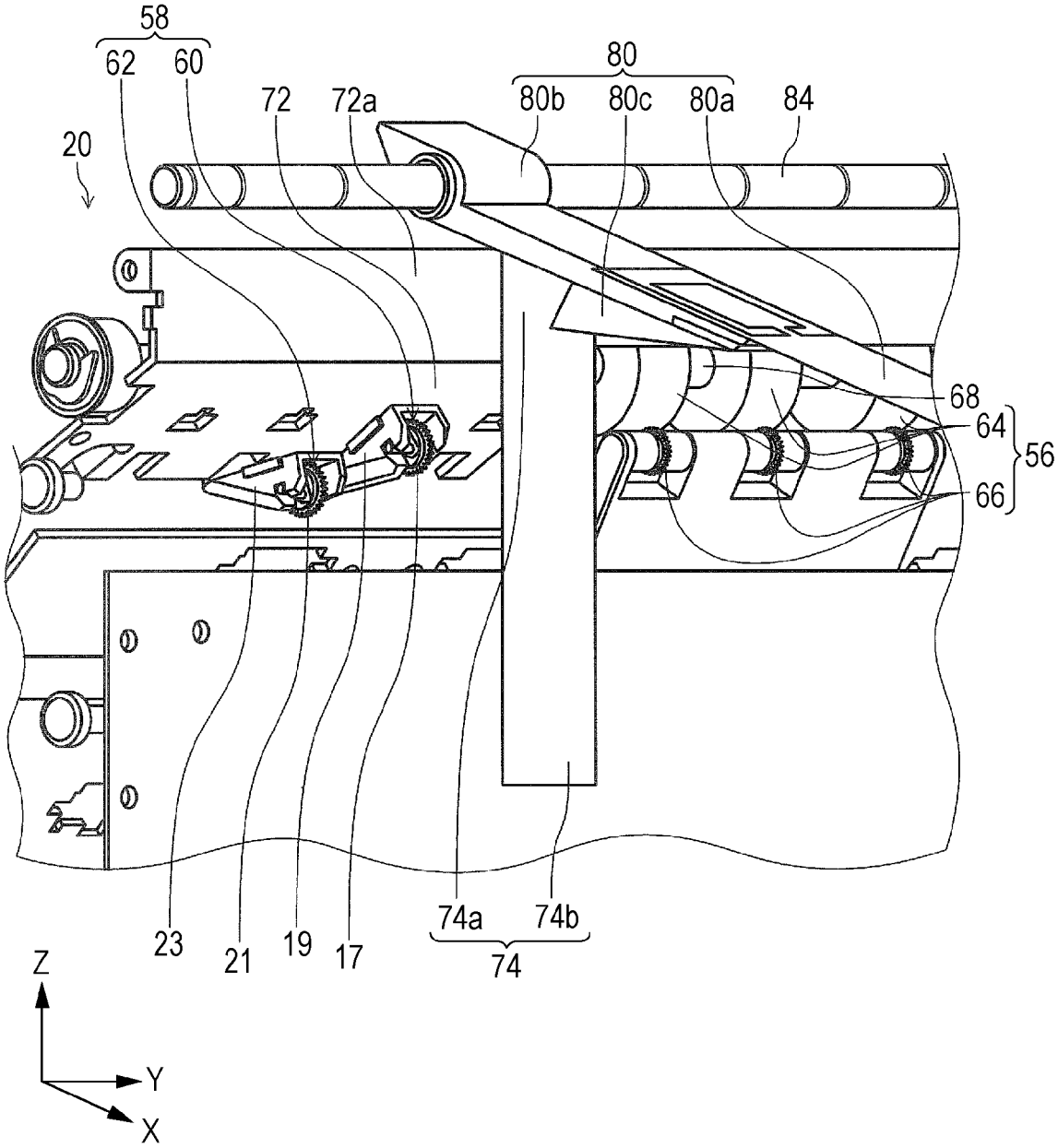
FIG. 4 is an enlarged perspective view of the main part showing the discharge section of the recording apparatus according to the embodiment of the invention.

Also, the first deformation member 60 is configured as a toothed roller 17 as shown in FIG. 4. The toothed roller 17 is held by a holder 19 as a rigid member. In this embodiment, the holder 19 is mounted in such a manner that a free end on a downstream side can swing in an up-and-down direction with respect to the frame 72 with an upstream side of the transport path 11 as a fulcrum.

The free end of the holder 19 is applied with a biasing force toward the transport surface of the transport path 11, and the first deformation member 60 is retractable against the biasing force by the recording medium P which is transported. In this embodiment, the first deformation member 60 is biased by the weight thereof in a −Z direction in FIG. 4, that is, to a transport surface side of the transport path 11. It is a matter of course that the biasing may be performed not by the weight thereof but by a biasing member such as a spring.

A swing stop point of the holder 19 is a position where the swinging stops with the free end of the holder 19 being in contact with the frame 72.

The second deformation member 62 is arranged in such a manner that a position 15 in contact with the recording medium P is a position of a distance L3 from the nip positions 70 on an upstream side (−X direction) of the transport path 11 from the nip positions 70 of the discharge rollers 56 in the transport direction (X-axis direction in FIG. 5). Also, the contact position 15 of the second deformation member 62 is arranged in such a manner as to be a position on a further upstream side than the contact position 13 of the first deformation member 60 in the transport path 11.

In this embodiment, it is preferable that the distance L3 be 15 mm or less considering an angle at which the recording medium P is bent, damage to the recording medium P, and the like. More preferably, the distance L3 is 3 mm to 12 mm. In this embodiment, the distance L3 is set to 8 mm.

Also, the second deformation member 62 is arranged in such a manner that the contact position 15 is a position of a distance L4 from the endmost nip position 70 outside the area of the nip positions 70 of the discharge rollers 56 in the width direction (Y-axis direction in FIG. 5) crossing the transport direction (X-axis direction in FIG. 5).

In this embodiment, it is preferable that the distance L4 be 120 mm or less considering the angle at which the recording medium P is bent, damage to the recording medium P, and the like. More preferably, the distance L4 is 20 mm to 100 mm. In this embodiment, the distance L4 is set to 80 mm.

Also, the second deformation member 62 is arranged on an outer side than the first deformation member 60 in the width direction (Y-axis direction in FIG. 5) crossing the transport direction.

Also, the second deformation member 62 is configured as a toothed roller 21 as shown in FIG. 4. The toothed roller 21 is held by a holder 23 as a rigid member. In this embodiment, the holder 23 is mounted in such a manner that a free end on a downstream side can swing in an up-and-down direction with respect to the frame 72 with an upstream side of the transport path 11 as a fulcrum.

The free end of the holder 23 is applied with the biasing force toward the transport surface of the transport path 11, and the second deformation member 62 is retractable against the biasing force by the recording medium P which is transported. In this embodiment, the second deformation member 62 is biased by the weight thereof in the −Z direction in FIG. 4, that is, to the transport surface side of the transport path 11. It is a matter of course that the biasing may be performed not by the weight thereof but by a biasing member such as a spring.

A swing stop point of the holder 23 is a position where the swinging stops with the free end of the holder 23 being in contact with the frame 72.

Second Bending Member

On a further downstream side of the transport direction than the contact positions (nip positions) 70 of the Fd discharge section 20 where the feeding force is applied to the recording medium P, the second bending member 74 is disposed to be in contact with the recording medium P and maintain the bending shape of the recording medium P which is bent by the first bending member 58 as it is.

In this specification, the meaning of "maintain the shape as it is" is not limited to completely maintaining the shape of the recording medium P bent by the first bending member 58 as it is. Instead, in a case where the bending shape is a U-shaped curl, the bending angle, the bending amount, and the like are allowed to be changed or, in a case where the bending shape is a wavy shape (cockling), wavy points, the number of waves, and the like are allowed to be changed. In other words, the meaning includes a change insofar as a significance of the shape of the recording medium P bent by the first bending member 58 is not lost.

Specifically, the second bending member 74 is disposed on a downstream side of the nip positions (contact positions) 70 of the Fd discharge section 20, that is, on a surface (surface on a side facing the Fd mounting section 22 which will be described later) 72*a* extending along an up-and-down direction (Z-axis direction in FIG. 4) which crosses the recording surface of the recording medium P sent from the Fd discharge section 20 in the frame 72.

The second bending member 74 is configured as a thin plate-shaped member that extends along the Z-axis direction in FIG. 4, and a base end section 74*a* is mounted on the surface 72*a* of the frame 72 on the side facing the Fd mounting section 22. Also, a tip end section 74*b* of the second bending member 74 is configured as a free end.

It is preferable that the shortest distance between the position of the second bending member 74 that is in contact with the recording medium P and the position of the first bending member 58 that is in contact with the recording medium P be 100 mm or less and, more preferably, 5 mm to 50 mm. Within this range, transmission of the shape of the biased recording medium P can be performed appropriately. Also, it is preferable that the distance between the position of the second bending member 74 that is in contact with the recording medium P and the position of the first bending member 58 that is in contact with the recording medium P be shorter than the length of the recording medium P in the transport direction (may not correspond to every type of recording medium).

In this manner, the transported recording medium P is not in a state of being out of contact with both of the first bending member 58 and the second bending member 74. Instead, the recording medium P is sent in a state of being in contact with one or both of the first bending member 58 and the second bending member 74. Accordingly, the biasing with which the bent state of the recording medium P is achieved is not released, which is preferable.

Also, the second bending member 74 has mobility. To "have mobility" means that the second bending member 74 is designed to be capable of moving in contact with the recording medium P, examples of which include rotating with a rotating shaft as a fulcrum, sliding about a moving shaft, and the second bending member 74 itself being bent and deformed. In other words, the "mobility" means that the second bending member 74 is designed in such a manner as to move while resisting a pressing force in a state of abutting against the transported recording medium P, receiving the pressing force resulting from the abutting from the recording medium P.

Again, the mobility may be obtained in abutting against the recording medium P. For example, a part of the second bending member 74 may be flexible and the second bending member 74 may be rotational. It is further preferable that at least a part of the member have flexibility and be rotational.

It is preferable that a flexible member be used as the second bending member 74 because this allows design at a low cost. Examples of the flexible member include rubber, sponge, and plastic.

Even with a structure in which a rigid body and a rotating body are combined with each other, a leading edge of the recording medium P can enter initially and be transported by pushing the second bending member 74, and the recording medium P may be pressed with a force of the weight with the progress even when the second bending member 74 is a rigid member. An element with a condition that has little load during the entering of the leading edge of the recording medium P and continues applying a downward force during the transport to press the curling may be used. For example, if the center of gravity is present in the vicinity of a central part of the second bending member 74 and returning to original is made by rotation using the weight thereof, downward bending is performed when the leading edge of the recording medium P is entered and entering to the side opposite to the center of rotation across the center of gravity is made so that addition of the recording medium P during the entering is relatively small. During the transport, pressing is possible if the curl is overcome by the weight of the rigid body itself. What is formed of a material such as polyethylene terephthalate (PET) is likely to satisfy this element and can be used at a low cost.

In this embodiment, the second bending member 74 is formed of a resin such as PET, a rubber material, and the like. Accordingly, in the second bending member 74, the tip end section 74*b* can be bent and deformed with respect to the base end section 74*a* when an external force is applied to the tip end section 74*b*.

When the second bending member 74 holds the recording medium P, the contact position 25 (FIG. 8) on the recording medium P is positioned on an outer side of the recording medium P in the width direction with respect to the contact position (nip position) 70 of the discharge roller 56 where the feeding force is applied to the recording medium P and is positioned (may be the same position) on an inner side with respect to the contact position 13 when the first bending member 58 bends the recording medium P, and is positioned on a further downstream side than the contact position (nip position) 70 of the discharge roller 56 in the transport direction of the recording medium P.

Mounting Section

Also, the Fd mounting section 22 where the recording medium P that is discharged from the Fd discharge section 20 is mounted is disposed on a downstream side of the Fd discharge section 20 along the transport path. The Fd mounting section 22 has a mounting surface 76 where the recording medium P is mounted. The mounting surface 76 extends in the +X direction in the X-axis direction in FIG. 2, and extends obliquely in a +Z direction in the Z-axis direction. The angle of inclination of the mounting surface 76 is set to be substantially parallel with the transport direction (refer to FIG. 2) of the recording medium P that is discharged from the discharge rollers 56.

Figure 3:
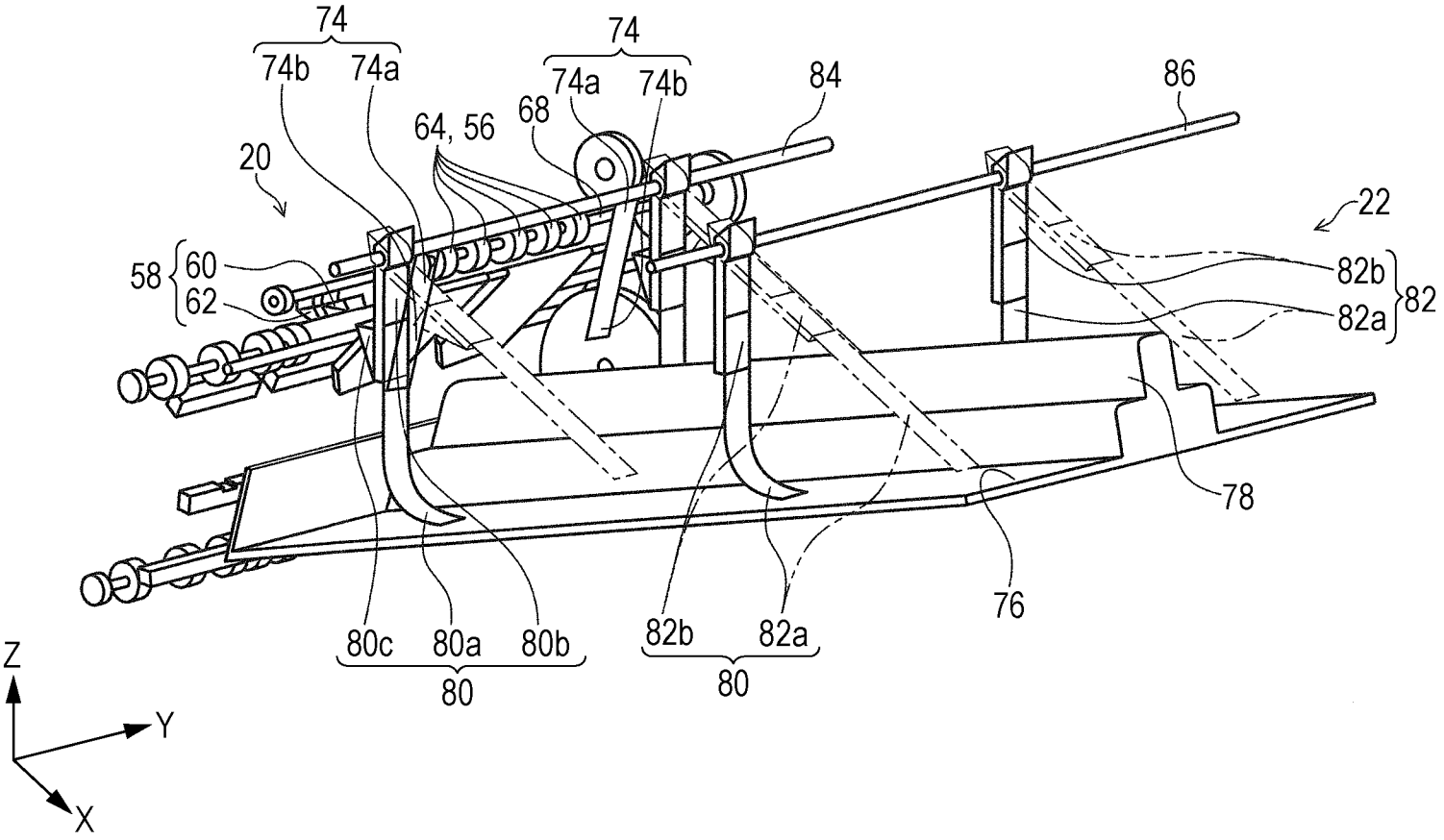
FIG. 3 is a perspective view of the main parts showing the discharge section and the mounting section of the recording apparatus according to the embodiment of the invention.

Also, the Fd mounting section 22 has a convex-shaped section 78 that projects in the +Z direction in a central portion of the mounting surface 76 in the width direction (Y-axis direction) crossing the transport direction in FIG. 3. In other words, the convex-shaped section 78 is disposed in the central portion of the Fd mounting section 22 in the width direction of the recording medium P.

The convex-shaped section 78 corresponds to the shape of the recording medium P that is sent from the discharge rollers 56 and is bent by the first bending member 58.

In other words, the convex-shaped section 78 extends in the X-axis direction on the mounting surface 76. Also, in this embodiment, the length of extension of the convex-shaped section 78 along the transport path 11 is set to be longer than the length of the recording medium P discharged by the discharge rollers 56 in the transport direction. In this embodiment, the length is set to be longer than the length of an A3 size sheet so as to correspond to a certain sheet, for example, the A3 size sheet.

First Biasing Member and Second Biasing Member

Also, a first biasing member 80 and a second biasing member 82 are disposed in the Fd mounting section 22. A structure in which only the first biasing member 80 is disposed may be used.

The first biasing member 80 is rotatably disposed in a support shaft 84 that extends in the width direction (Y-axis direction) crossing the transport direction in the mounting section 22. Although not shown, the support shaft 84 is mounted on a frame of the recording apparatus 10. Also, the support shaft 84 is disposed on an upper side in the Z-axis direction than a height position of the nip position 70 of the discharge roller 56, that is, in the +Z direction.

Also, a pair of the first biasing members 80 are arranged with an interval in the width direction (Y-axis direction, refer to FIG. 9) crossing the transport direction, and a position 27 where the first biasing member 80 is in contact with the recording medium P is arranged on an outer side than the contact position 25 of the second bending member 74. Further, the first biasing member 80 is arranged on a further downstream side than the second bending member 74 in the transport direction (refer to FIGS. 1 and 2).

At least a part of the first biasing member 80 has mobility. The mobility means that the first biasing member 80 may be configured to be capable of moving about a rotating shaft fulcrum or the first biasing member 80 may be configured to be capable of moving by sliding in a moving shaft. It is preferable that at least a part be configured as a flexible member because design at a low cost is possible. In a case where the first biasing member 80 is a rigid member capable of moving about the rotating shaft fulcrum or the first biasing member 80 is configured to be capable of moving by sliding in the moving shaft, the first biasing member 80 is disposed in a portion that can be touched by a user, but it is possible to prevent accidental damage to the first biasing member 80 caused by the user.

As a specific example, a tip end section 80*a* of the first biasing member 80 that abuts against the mounting surface 76 is configured as a thin plate member of a resin such as PET, a rubber material, and the like. Accordingly, when an external force is applied to the tip end section 80*a*, the tip end section 80*a* of the first biasing member 80 can be bent and deformed.

Figure 2:
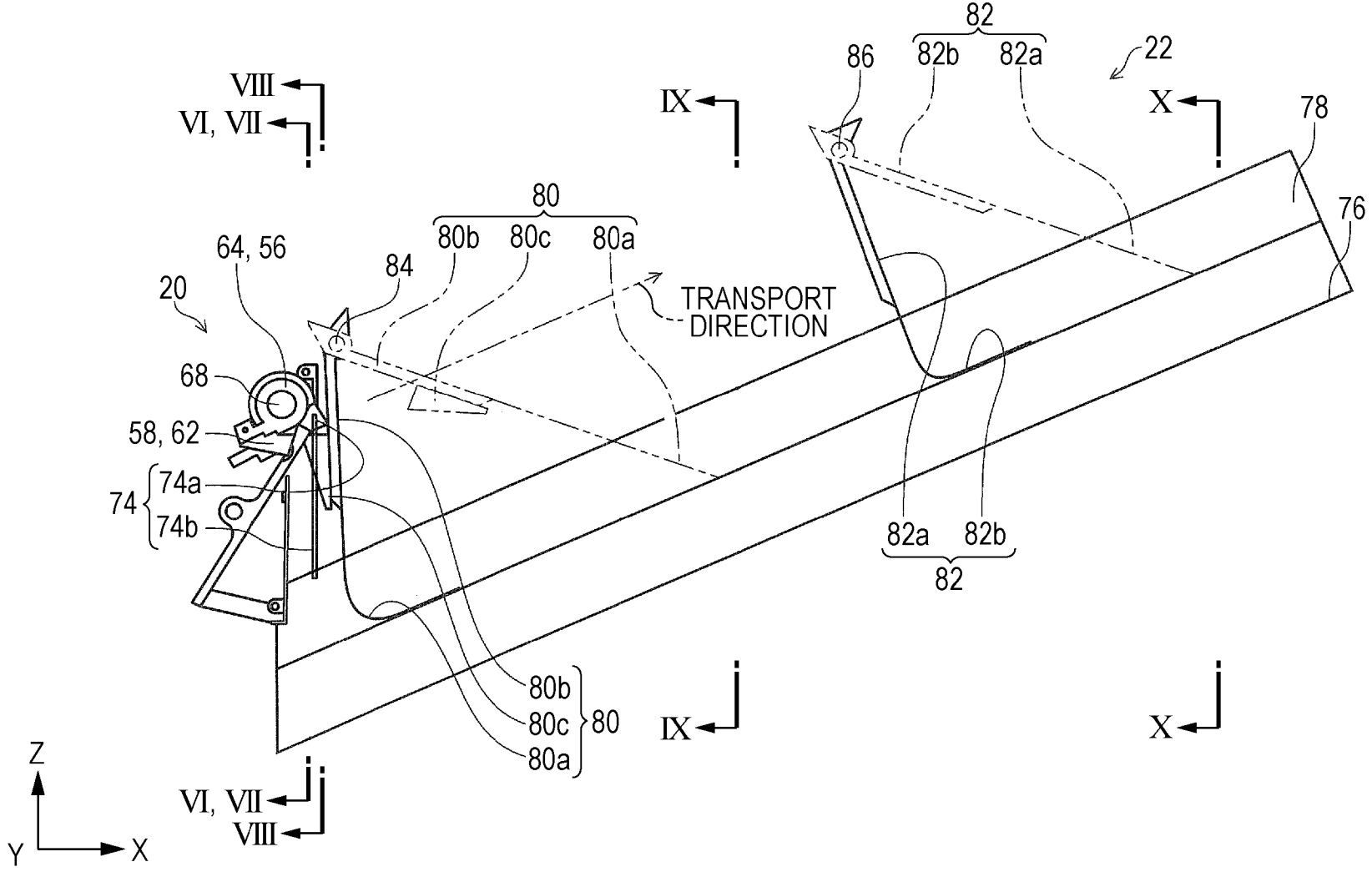
FIG. 2 is a side cross-sectional view of main parts showing a discharge section and a mounting section of the recording apparatus according to the embodiment of the invention.

In this manner, the first biasing member 80 is in a state of sagging from the support shaft 84 due to the weight thereof, as shown in FIGS. 2 and 3, in a case where no external force is applied to the first biasing member 80. In this case, the tip end section 80*a* of the first biasing member 80 abuts against the mounting surface 76 to be in a bent state. Also, the support shaft 84 is inserted into a base end section 80*b* of the first biasing member 80. In this manner, the first biasing member 80 is rotatable with the support shaft 84 as a rotation fulcrum.

Further, a guiding unit 80*c* is disposed in the base end section 80*b* of the first biasing member 80. The guiding unit 80*c* is disposed in such a manner as to face a transport direction upstream side in the base end section 80*b*. The guiding unit 80*c* guides a tip end side Pf of the recording medium P from a base end toward a tip end section 80*a* side when the tip end side Pf of the recording medium P abuts against the guiding unit 80*c* (refer to FIG. 2).

The second biasing member 82 is rotatably disposed in a support shaft 86 that extends in the width direction crossing the transport direction, that is, in the Y-axis direction in the mounting section 22. Although not shown, the support shaft 86 is mounted on the recording apparatus 10. Also, the support shaft 86 is disposed on an upper side than the support shaft 84 in the Z-axis direction, that is, in the +Z direction.

Also, a pair of the second biasing members 82 are arranged with an interval in the width direction crossing the transport direction, that is, in the Y-axis direction (refer to FIG. 10), and, a position 29 where the second biasing member 82 is in contact with the recording medium P is arranged on an outer side than the contact position 27 of the first biasing member 80.

The contact positions 27 of the pair of first biasing members 80 may be arranged on an outer side than the contact positions 29 of the pair of second biasing members 82. In the "outer side" arrangement, in a case where the recording medium P is curled along the transport direction (so-called vertical curl), curling may be initiated on the tip end side if the length of the recording medium P in the transport direction is long even when the recording medium P is pressed by the first biasing member 80. However, it is preferable that the second biasing member 82 be arranged on an inner side than the first biasing member 80. It is preferable that the first biasing member 80 be arranged as close as possible to both end sides of the recording medium P so as to strongly suppress the curling of the recording medium P and the second biasing member 82 be positioned on an inner side than the first biasing member 80 so as to correspond to many types of recording media.

Further, the second biasing member 82 is arranged on a further downstream side than the first biasing member 80 in the transport path (refer to FIGS. 1 and 2).

It is preferable that the second biasing member 82 have mobility. The mobility means that the second biasing member 82 may be configured to be capable of moving about a rotating shaft fulcrum or the second biasing member 82 may be configured to be capable of moving by sliding in a moving shaft. It is preferable that at least a part be configured as a flexible member because design at a low cost is possible. In a case where the second biasing member 82 is a rigid member capable of moving about a rotating shaft fulcrum or the second biasing member 82 is configured to be capable of moving by sliding in a moving shaft, the second biasing member 82 is disposed in a portion that can be touched by a user, but it is possible to prevent accidental damage to the second biasing member 82 caused by the user.

As a specific example, a tip end section 82*a* of the second biasing member 82 that abuts against the mounting surface 76 is configured as a thin plate member of a resin such as PET, a rubber material, and the like. Accordingly, when an external force is applied to the tip end section 82*a*, the tip end section 82*a* of the second biasing member 82 can be bent and deformed.

In this manner, the second biasing member 82 is in a state of sagging from the support shaft 86 due to the weight thereof, as shown in FIGS. 2 and 3, in a case where no external force is applied to the second biasing member 82. In this case, the tip end section 82*a* of the second biasing member 82 abuts against the mounting surface 76 to be in a bent state. Also, the support shaft 86 is inserted into a base end section 82*b* of the second biasing member 82. In this manner, the second biasing member 82 is rotatable with the support shaft 86 as a rotation fulcrum.

Description of Change in State of Transported Recording Medium

Next, a change in state of the recording medium P during the transport process will be described with reference to FIGS. 6 to 10.

The recording medium P is transported toward the Fd discharge section 20 through the transport path 11 after recording is performed by the recording unit 18. In this case, the recording medium P abuts against the second deformation member 62, the first deformation member 60, and the discharge roller 56 in order from an upstream side of the transport path 11 in the Fd discharge section 20.

Figure 6:
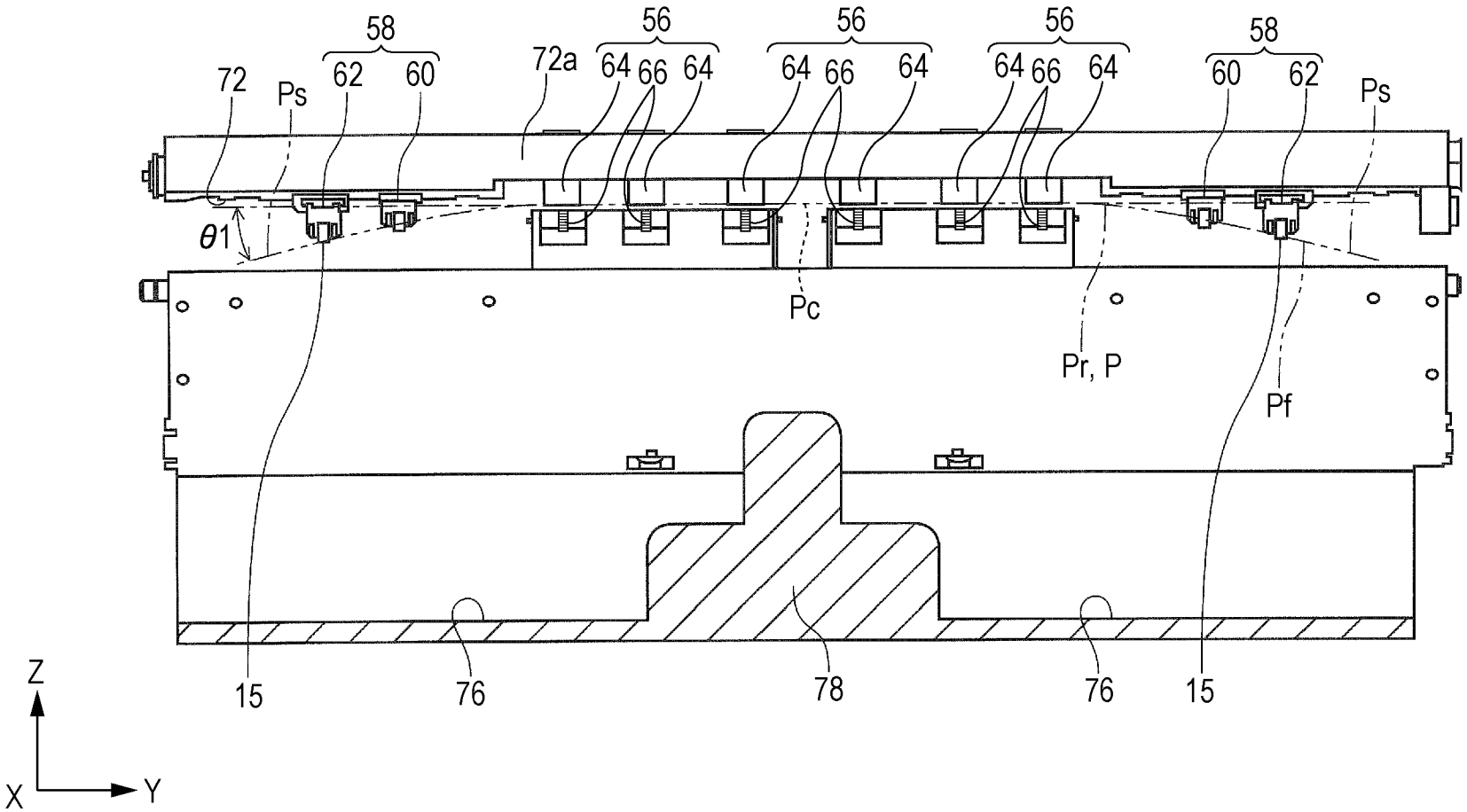
FIG. 6 is a cross-sectional view showing a state where a second deformation member and a recording medium abut against each other in a cross-section taken along line VI-VI of FIG. 2.

Referring to FIG. 6, the tip end side Pf of the recording medium P that is transported from the recording unit 18 along the transport path 11 abuts against the second deformation member 62 in both side portions (end sections) Ps in the width direction (Y-axis direction in FIG. 6) of the recording medium P crossing the transport direction. Accordingly, both of the side portions Ps are biased to a recording surface Pr side by the second deformation member 62. As a result, both of the side portions Ps are displaced, that is, deformed at a bending amount (bending angle) θ1 with respect to the central portion Pc of the recording medium P in the width direction (Y-axis direction in FIG. 6).

Also, in this embodiment, the second deformation member 62 is biased to a facing transport path 11 side due to the weight thereof. Accordingly, the second deformation member 62 rotates between the frame 72 and the transport path 11 in response to the rigidity of the deformed recording medium P. In this manner, the second deformation member 62 can self-regulate the amount of deformation, that is, the bending amount (bending angle) θ1 of both of the side portions Ps of the recording medium P with respect to the central portion Pc.

Figure 7:
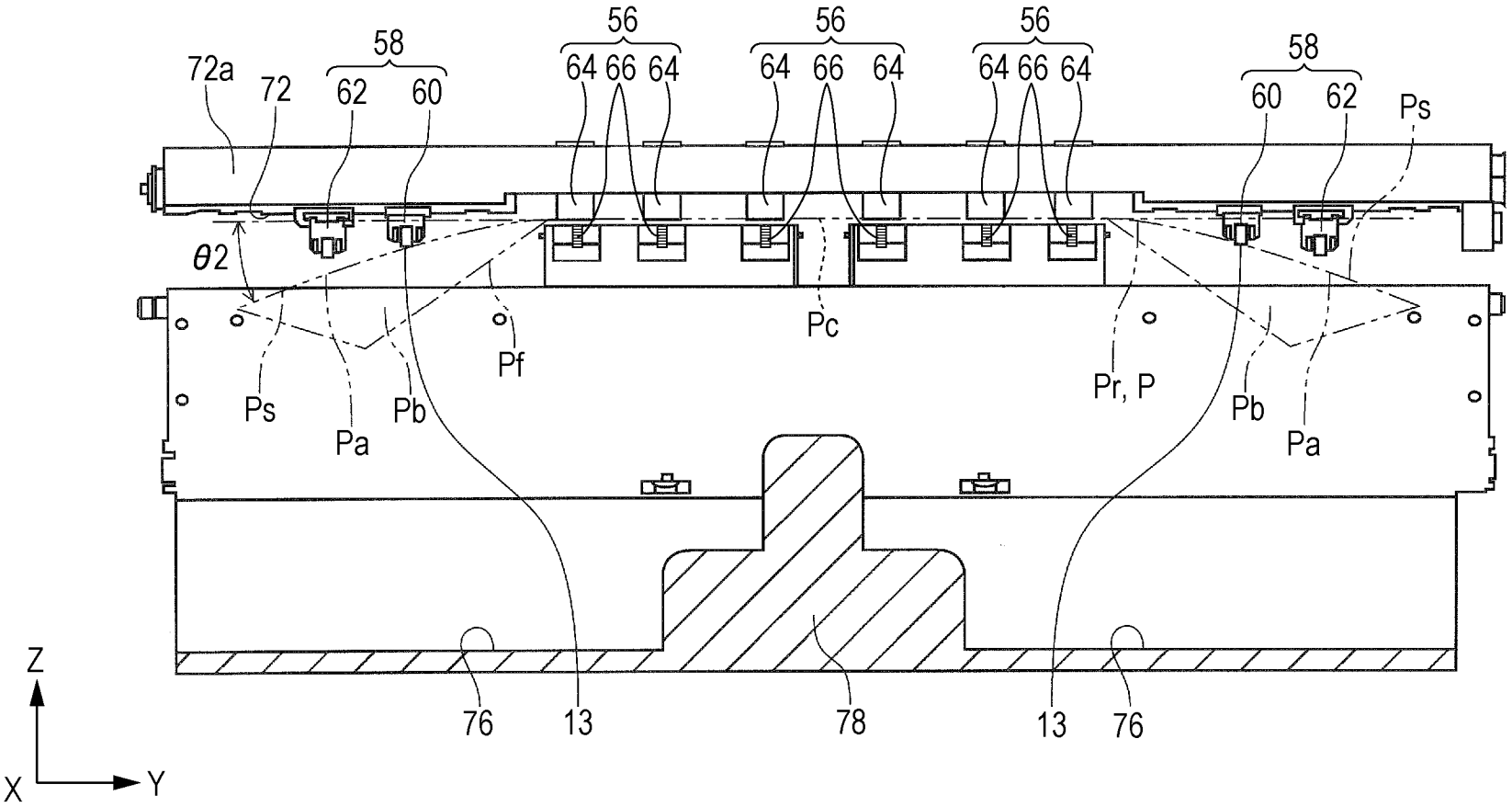
FIG. 7 is a cross-sectional view showing a state where a first deformation member and the recording medium abut against each other in the cross-section taken along line VII-VII of FIG. 2.

Next, the recording medium P is further transported to a downstream side along the transport path 11 after both of the side portions Ps are deformed by the second deformation member 62, and both of the side portions Ps abut against the first deformation member 60 which is mounted on the frame 72 (refer to FIG. 7). In this embodiment, a lower end position of the first deformation member 60 in the Z-axis direction in FIG. 7 is positioned on a further +Z direction side than a lower end position of the second deformation member 62. In other words, the lower end position of the first deformation member 60 is positioned above the lower end position of the second deformation member 62.

However, the first deformation member 60 is arranged on an inner side than the second deformation member 62 in the width direction crossing the transport direction, that is, at a position closer to the nip position 70 of the discharge roller 56. In this manner, both of the side portions Ps of the recording medium P can be displaced, that is, deformed with respect to the central portion Pc at a bending amount (bending angle) θ2 which is larger than the bending amount (bending angle) θ1.

Accordingly, the amount of deformation, that is, the bending amount of both of the side portions Ps can be gradually increased from the bending amount θ1 and then to the bending amount θ2 from a flat state along the transport surface of the transport path with respect to the central portion Pc of the recording medium P. As a result, the amount of deformation of both of the side portions Ps of the recording medium P is increased, and thus flexibility of the recording medium P can be strengthened.

Also, the displacement of both of the side portions Ps with respect to the central portion Pc of the recording medium P can be divided into a plurality of times. In this manner, both of the side portions Ps can be deformed reasonably with respect to the central portion Pc. Accordingly, a force inhibiting the transport of the recording medium P in the transport direction can be reduced or suppressed. As a result, jamming of the recording medium P in the transport path can be suppressed or prevented.

Also, the second deformation member 62 is disposed at a position within 15 mm (L3 of FIG. 5) on an upstream side of the transport path 11 from the nip position 70 of the discharge roller 56 with respect to the recording medium P, and thus the distance between the second deformation member 62 and the discharge roller 56 in the transport path 11 is short. In this manner, even when a force inhibiting the transport of the recording medium P is generated, the central portion Pc on the tip end side Pf abuts against the discharge roller 56, is nipped, and is transported to a downstream side of the transport path 11 immediately after the tip end side Pf of the recording medium P is deformed by the second deformation member 62. As a result, a reduction in transport speed of the recording medium P can be suppressed, and the possibility of jamming in the transport path 11 caused by a reduction in transport speed of the recording medium P and collision with the next or subsequent recording medium P can be reduced.

Also, when the first deformation member 60 and the second deformation member 62 abut against the recording medium P, the first deformation member 60 and the second deformation member 62 are not significantly bent since the first deformation member 60 and the second deformation member 62 are configured as rigid members, and can deform, that is, bend the recording medium P at a bending amount which is set. Also, the rigid members can also resist the reaction force of the recording medium P to return from the bent state to the original flat state, and thus the bending shape of the recording medium P can be maintained.

Further, the recording medium P is further transported to a downstream side along the transport path 11 and the central portion Pc is pinched by the discharge driving roller 64 and the discharge driven roller 66 after both of the side portions Ps on the tip end side Pf are deformed by the first deformation member 60 (refer to FIG. 7). The two-dot chain line in FIG. 7 shows a deformed state of the tip end side Pf. The recording medium P is sent from the nip positions 70 to a transport direction downstream side by the discharge rollers 56. In this case, the central portion Pc of the recording medium P is nipped by the nip positions 70 of the discharge rollers 56 (refer to FIG. 5).

Accordingly, a curved bent portion Pa (refer to FIGS. 5 and 7) of the recording medium P that extends to a transport direction downstream side from the central portion Pc on the tip end side Pf and extends to both of the side portions Ps via the first deformation member 60 and the second deformation member 62 is formed. Specifically, when the recording medium P is viewed from a recording surface Pr of the recording medium P, a substantially triangularly deformed portion Pb (refer to FIGS. 5 and 7) is formed on the tip end side Pf of the recording medium P in the transport direction. Accordingly, the flexibility of the recording medium P can be strengthened along the bent portion Pa of the recording medium P. Accordingly, the flexibility of the recording medium P can be strengthened in the transport direction (X-axis direction in FIG. 5) and in the width direction (Y-axis direction in FIG. 5) crossing the transport direction by deforming the recording medium P along the bent portion Pa.

Specifically, the triangularly deformed portion Pb of the recording medium P is deformed to the recording surface Pr side. In other words, the first bending member 58 can bend both of the side portions Ps of the recording medium P on the tip end side Pf in the transport direction so that the recording surface Pr is inside the central portion Pc on the tip end side Pf. Accordingly, the flexibility of the recording medium P can be strengthened in the transport direction (X-axis direction in FIG. 5) and the direction crossing the transport direction (Y-axis direction in FIG. 5), and thus a force to curl the recording medium P to the side opposite to the recording surface Pr can be resisted.

As a result, curling of both of the side portions Ps of the recording medium P along the transport direction (X-axis direction in FIG. 5) with the recording surface Pr outside and curling of the tip end side Pf of the recording medium P sent from the discharge rollers 56 with the width direction (Y-axis direction in FIG. 5) crossing the transport direction as an axis can be suppressed or prevented.

Figure 8:
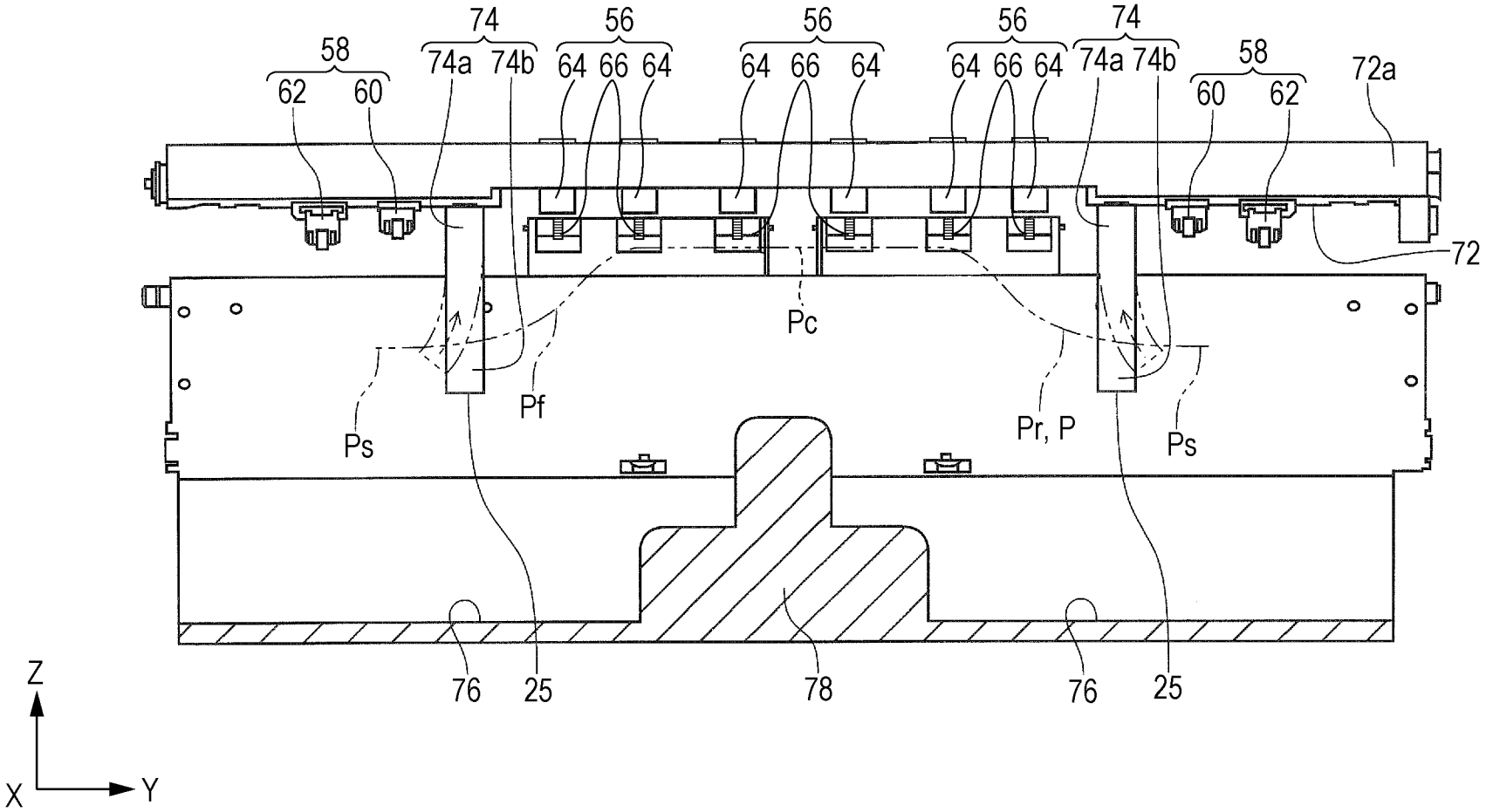
FIG. 8 is a cross-sectional view showing a state where a second bending member and the recording medium abut against each other in a cross-section taken along line VIII-VIII of FIG. 2.

Next, as shown in FIG. 8, the tip end side Pf of the recording medium P abuts against the second bending member 74 when the recording medium P is sent downstream from the nip positions 70 by the discharge rollers 56. In this case, since having mobility, the second bending member 74 is pressed to the tip end side Pf of the recording medium P and is lifted in the +Z direction. In this manner, the tip end section 74*b* of the second bending member 74 is bent and is in surface contact following the surface on the side opposite to the recording surface Pr by following the bending shape of the recording medium P which is bent by the first bending member 58.

Accordingly, a holding force (refer to the arrow in FIG. 8) is generated between the tip end section 74*b* of the second bending member 74 and the recording medium P. The holding force acts in a direction inhibiting the returning of the bent recording medium P to the original flat state. Further, the tip end section 74*b* of the second bending member 74 is bent so that the second bending member 74 biases the recording medium P from the direction opposite to the recording surface Pr toward the recording surface Pr.

The holding force and the biasing force inhibit the returning of the recording medium P from the bent state to the original flat state or the deformation of the recording medium P to the side opposite to the recording surface Pr. As a result, the second bending member 74 can maintain the bending shape of the recording medium P deformed, that is, bent by the first bending member 58 as it is.

Also, the second bending member 74 is disposed to be positioned on an inner side than the contact position 13 of the first bending member 58 on both sides of the nip position 70 of the discharge roller 56 in the width direction crossing the transport direction, that is, the Y-axis direction in FIG. 8. Accordingly, the second bending member 74 abuts in such a manner as to pinch the bent portion of the recording medium P from an outer side in the Y-axis direction.

In this manner, the second bending member 74 can suppress or prevent the returning of the bending shape of the recording medium P to a flat state. As a result, the second bending member 74 can suppress or prevent the curling of the recording medium P to the side opposite to the side bent by the first bending member 58.

Also, when the recording medium P is sent from the discharge rollers 56, an effect of restriction (nip) in the Z-axis direction (FIG. 8) with respect to the central portion Pc by the group of the plurality of discharge rollers 56 gradually decreases. As a result, the biasing force of the second bending member 74 comes into play as a tip end section of the recording medium P is moved from the nip positions 70 of the discharge rollers 56 to the transport direction downstream side to be separated, and the central portion Pc of the recording medium P is also gradually deformed, that is, bent from the flat state with the recording surface Pr inside.

Figure 9:
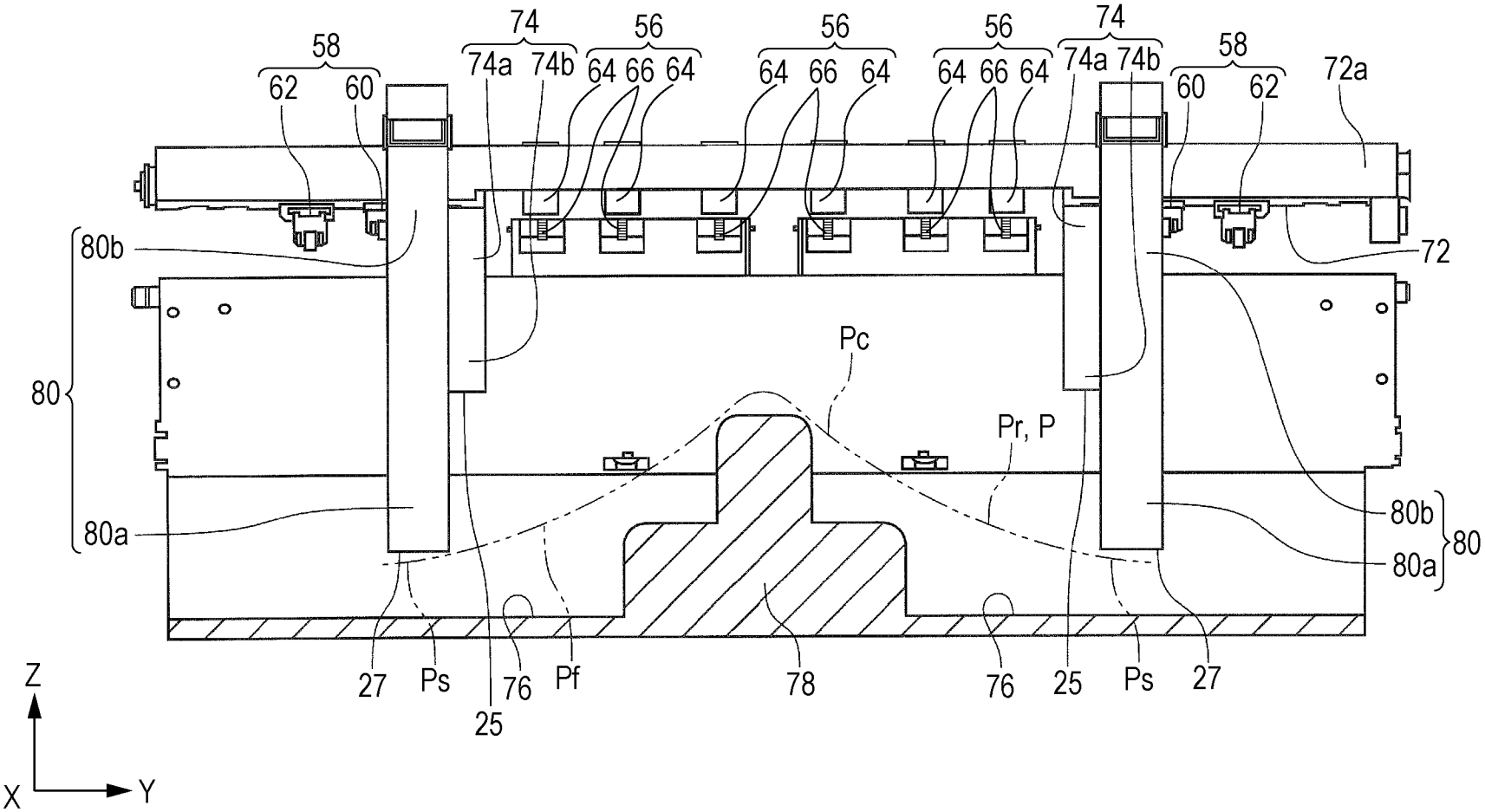
FIG. 9 is a cross-sectional view showing a state where a first biasing member and the recording medium abut against each other in a cross-section taken along line IX-IX of FIG. 2.

Next, when the tip end side Pf of the recording medium P is further sent from the second bending member 74 to the transport direction downstream side as shown in FIG. 9, the recording medium P abuts against the first biasing member 80. In this case, as shown in FIG. 2, the first biasing member 80 is in a sagging state due to the weight thereof, and the tip end section 80*a* is in a bent state with respect to the mounting surface 76. When the recording medium P is transported from the second bending member 74, the tip end side Pf of the recording medium P abuts against the guiding unit 80*c* (refer to FIG. 2) first.

Then, the tip end side Pf of the recording medium P is guided toward a tip end section 80*a* side by the guiding unit 80*c*. In this case, the tip end side Pf of the recording medium P acts in a direction in which the guiding unit 80*c* is lifted in the +Z direction in FIG. 2, and this causes the first biasing member 80 to rotate about the support shaft 84. In other words, the first biasing member 80 rotates to the transport direction downstream side with the support shaft 84 as a fulcrum. In this manner, the first biasing member 80 does not inhibit discharge of the recording medium P toward the mounting surface 76.

Further, when the tip end side Pf of the recording medium P abuts against the tip end section 80*a*, the tip end section 80*a* biases the recording medium P from a direction opposite to the recording surface Pr toward the recording surface Pr, that is, to a mounting surface 76 side due to the weight of the first biasing member 80 itself. In this manner, bending occurs in the tip end section 80*a* and surface contact is made following the surface on the side opposite to the recording surface Pr by following the bending shape of the recording medium P which is bent by the first bending member 58.

Accordingly, a holding force is generated between the tip end section 80*a* of the first biasing member 80 and the recording medium P. The holding force acts in a direction inhibiting the returning of the bent recording medium P to the original flat state. The holding force and the biasing force toward the mounting surface 76 side cause the first biasing member 80 to inhibit the returning of the recording medium P from the bent state to the original flat state or the deformation of the recording medium P to the side opposite to the recording surface Pr.

Also, when the recording medium P is sent to the transport direction downstream side (refer to FIGS. 2 and 9) while abutting against the first biasing member 80, the central portion Pc of the recording medium P on the tip end side Pf is transported to the transport direction downstream side while abutting the convex-shaped section 78 of the mounting section 22 since the recording medium P is biased to the mounting surface 76 side by the first biasing member 80.

Accordingly, a frictional force is generated between the tip end side Pf of the recording medium P and the convex-shaped section 78. The frictional force acts in the direction opposite to the transport direction, that is, from the transport direction upstream side toward the downstream side to press the tip end side Pf of the recording medium P to the convex-shaped section 78, and thus the curling of the tip end side Pf of the recording medium P to the side opposite to the convex-shaped section 78, that is, the side opposite to the recording surface Pr can be suppressed.

Next, when the recording medium P is further sent from the first biasing member 80 to the transport direction downstream side, the recording medium P abuts against the second biasing member 82. In this case, as shown in FIG. 2, the second biasing member 82 is also in a sagging state due to the weight thereof as is the case with the first biasing member 80, and the tip end section 82*a* is in a bent state with respect to the mounting surface 76. When the recording medium P is transported from the first biasing member 80, the tip end of the recording medium P abuts against the tip end section 82*a* (refer to FIG. 2).

In this case, the tip end section 82*a* of the second biasing member 82 is lifted in the +Z direction in FIG. 2 by the tip end side Pf of the recording medium P. In other words, the second biasing member 82 rotates to the transport direction downstream side with the support shaft 86 as a fulcrum. In this manner, the second biasing member 82 does not inhibit the transport of the recording medium P toward the mounting surface 76.

Also, the tip end section 82*a* biases the recording medium P from the direction opposite to the recording surface Pr toward the recording surface Pr, that is, to the mounting surface 76 side due to the weight of the second biasing member 82 itself. In this manner, bending occurs in the tip end section 82*a* and surface contact is made following the surface on the side opposite to the recording surface Pr by following the bending shape of the recording medium P which is bent by the first bending member 58.

Accordingly, a holding force is generated between the tip end section 82*a* of the second biasing member 82 and the recording medium P. The holding force acts in a direction inhibiting the returning of the bent recording medium P to the original flat state. The holding force and the biasing force toward the mounting surface 76 side cause the second biasing member 82 to inhibit the returning of the recording medium P from the bent state to the original flat state or the deformation of the recording medium P to the side opposite to the recording surface Pr.

When a rear end side Pe (refer to FIG. 10) of the recording medium P passes through the nip positions 70 of the discharge rollers 56, the recording medium P is mounted on the mounting surface 76 of the mounting section 22 in a biased state (refer to FIG. 10) due to the biasing force caused by the weight of the first biasing member 80 and the second biasing member 82 themselves.

Figure 10:
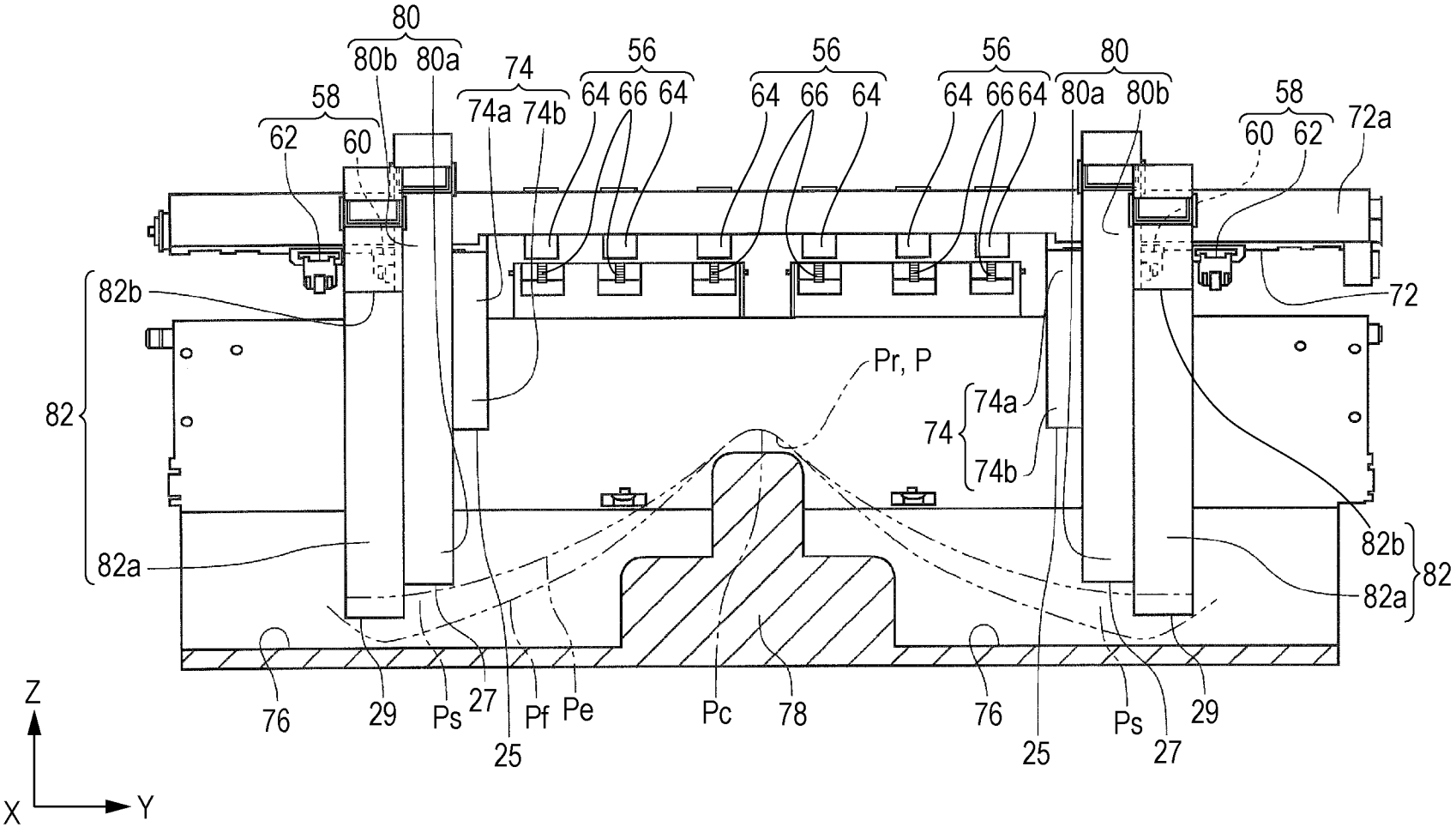
FIG. 10 is a cross-sectional view showing a state where a second biasing member and the recording medium abut against each other in a cross-section taken along line X-X of FIG. 2.

Also, the recording medium P that is mounted on the mounting section 22 is mounted while maintaining the bending shape with the recording surface Pr inside as shown in FIG. 10. In this case, the first biasing member 80 biases the rear end side Pe of the recording medium P from the side opposite to the recording surface Pr toward the mounting surface 76. Further, the first biasing member 80 is bent following the bending shape of the recording medium P, and an inner side portion of the tip end section 80*a* of the first biasing member 80 regulates a movement thereof for displacement in the direction (Y-axis direction in FIG. 10) crossing the transport direction so that the recording medium P is returned from the bending shape to the flat state.

Also, the second biasing member 82 biases the tip end side Pf of the recording medium P from the side opposite to the recording surface Pr toward the mounting surface 76. Further, the second biasing member 82 is bent following the bending shape of the recording medium P, and an outer side portion of the tip end section 82*a* of the second biasing member 82 regulates a movement thereof so that the recording medium P is curled from the tip end side Pf toward the side opposite to the recording surface Pr.

Also, the convex-shaped section 78 also regulates the displacement of the central portion Pc of the recording medium P in the Z-axis direction of FIG. 10 with respect to the movement of the recording medium P to return from the bent state to the flat state, and thus the bent state of the recording medium P is maintained.

As a result, the bending shape of the recording medium P that is mounted on the mounting section 22 is maintained by the first biasing member 80, the second biasing member 82, and the convex-shaped section 78. Further, the first biasing member 80 and the second biasing member 82 bias the recording medium P with respect to the mounting surface 76 in the mounting section 22, and can suppress or prevent rising of the recording medium P from the mounting surface 76.

Accordingly, even when a plurality of sheets of the recording medium P are transported in the mounting section 22, the recording medium P can be stacked in a bent state. As a result, the recording medium P can be mounted on the mounting section 22 in an appropriate state.

Modification Example of First Embodiment (1) In this embodiment, the first deformation member 60 and the second deformation member 62 are configured to be capable of swinging with respect to the frame 72. However, at least one of the first deformation member 60 and the second deformation member 62 may be configured to be fixed to the frame 72 or both thereof may be configured to be fixed thereto.

(2) In this embodiment, the first deformation member 60 and the second deformation member 62 are configured to be biased to the transport path due to the weight thereof. However, another biasing means such as a spring, hydraulic pressure, and pneumatic pressure may be used, instead of the weight thereof or in addition to the weight thereof, as means for biasing at least one of the first deformation member 60 and the second deformation member 62.

(3) In this embodiment, at least one of the first biasing member 80 and the second biasing member 82 is configured to rotate with respect to the support shafts 84 and 86. Instead, at least one of the first biasing member 80 and the second biasing member 82 may be configured to be fixed to the support shafts 84 and 86. In this case, the degree of flexibility of the first biasing member 80 and the second biasing member 82 is appropriately adjusted so that a function as the biasing member is ensured.

(4) In this embodiment, the first bending member 58, the second bending member 74, the convex-shaped section 78, the first biasing member 80, and the second biasing member 82 are configured to be disposed in the Fd discharge section 20. However, some or all of the first bending member 58, the second bending member 74, the convex-shaped section 78, the first biasing member 80, and the second biasing member 82 may be configured to be disposed in the Fu discharge section 26 and the Fu mounting section 28.

(5) The recording medium can be bent into a W shape by transporting the recording medium P after bending the recording medium P into a U shape with the recording surface Pr inside and causing the central portion outside the U shape to abut against a projecting section which is disposed at a central position of the mounting section 22. With the W-shaped bending, the development of the curling can be further suppressed.

Conclusion

In conclusion, the recording apparatus 10 according to this embodiment includes the recording unit 18 that performs recording on the recording surface Pr of the recording medium P, the discharge section 20 that discharges the recording medium P which is transported from the recording unit 18 along the transport path 11, and the first bending member 58 that is in contact with the recording medium P passing through the recording unit 18 in the transport path 11 and transported toward the discharge section 20 to bend the recording medium P. The first bending member 58 displaces both of the side portions Ps of the recording medium P in the width direction with respect to the central portion Pc of the recording medium P in the width direction of the recording medium P at a position on a further upstream side in the transport direction than the contact positions (nip positions) 70 of the discharge section 20 that apply the feeding force to the recording medium P, and the recording medium P is bent in such a manner that the recording surface Pr is directed inside.

According to the above-described configuration, the first bending member 58 displaces both of the side portions Ps of the transported recording medium P with respect to the central portion Pc at a position on a further upstream side than the contact positions 70 of the discharge section 20, and bends the recording medium P in such a manner that the recording surface Pr is directed inside. In this manner, the transported recording medium P is bent by the first bending member 58 first at a position on a further upstream side than the discharge section 20, and is discharged by receiving the feeding force from the discharge section 20 in the bending shape on a further downstream side than the first bending member 58. In this manner, the flexibility of the recording medium P can be strengthened in the transport direction of the recording medium P and the width direction crossing the transport direction.

Accordingly, both the curling in the transport direction and the curling in the width direction crossing the transport direction can be suppressed in the recording medium which is transported in a discharge direction from the discharge section 20.

In the recording apparatus 10 according to this embodiment, the discharge section 20 has the discharge roller 56 that is positioned in a central portion of the transport path 11 in the width direction of the transported recording medium P, and the first bending member 58 has the first deformation member 60 that is in contact with the recording medium P on an upstream side in the transport direction with respect to the contact position 70 of the discharge roller 56 applying the feeding force to the recording medium P and at both of the outer side positions 13 in the width direction with respect to the contact position 70 of the discharge roller 56.

According to this configuration, the discharge roller 56 is in contact with the central portion Pc of the transported recording medium P in the width direction. Further, the first deformation member 60 is in contact with the recording medium P on an upstream side with respect to the contact position 70 of the discharge roller 56 and at both of the outer side positions 13 with respect to the contact position 70 of the discharge roller 56 positioned in the central portion in the width direction. The above-described three-point contact structure causes the bending shape to be formed in such a manner that the recording surface Pr of the recording medium P is directed inside.

The above-described three-point contact structure is configured to have the discharge roller 56 that corresponds to an apex angle position of a triangle and a pair of the first deformation members 60 that correspond to base angle positions of the triangle. Further, the first deformation member 60 is configured to be in contact with the transported recording medium P at a position shifted to the bent side with respect to a reference plane based on the plane through the contact position 70 of the discharge roller 56 toward the recording medium P and along the transport surface of the transport path 11.

In other words, a contact point (70) where the discharge roller 56 is in contact with the recording medium P and contact points (13, 13) where the pair of first deformation members 60 are in contact with the recording medium P are shifted with respect to the transport direction and with respect to the direction (direction crossing the transport surface of the transport path 11) crossing the reference plane.

Referring to the above-described contact structure based on the shifted contact points as a three-dimensional contact structure according to this aspect, the three-dimensional contact structure allows the flexibility of the recording medium P to be further strengthened in the transport direction of the recording medium P and in the width direction crossing the transport direction. Accordingly, both the curling in the transport direction and the curling in the width direction crossing the transport direction can be further suppressed in the recording medium P which is transported in the discharge direction from the discharge section 20.

In the recording apparatus 10 according to this embodiment, the first bending member 58 has the second deformation member 62 that is in contact with the recording medium P on an upstream side in the transport direction of the recording medium with respect to the position 13 where the first deformation member 60 is in contact with the recording medium P in the transport direction and at both of the outer side positions 15 in the width direction with respect to the contact position 13 of the first deformation member 60.

According to this configuration, in the transport path 11, the second deformation member 62 is in contact with the recording medium P on an upstream side with respect to the contact position 13 where the first deformation member 60 is in contact with the recording medium P and at both of the outer side positions 15 in the width direction. In this manner, the bending of the recording medium P can be initiated (first-stage bending) by the second deformation member 62 from both of outer side portions (15) which are far from the central portion Pc of the recording medium P, and then the bending can be in progress (second-stage bending) by the first deformation member 60 on a side closer to the central portion Pc than to the second deformation member 62, that is, at inner-side positions (13).

In other words, the bending of the recording medium P can be divided into a plurality of times and performed phase by phase. In this manner, the recording medium P can be bent by reasonably displacing both of the side portions Ps with respect to the central portion Pc.

Also, the transport resistance of the recording medium P generated by disposing the first bending member 58 can be suppressed to be small. As a result, the possibility of jamming of the recording medium P in the transport path 11 can be reduced.

In the recording apparatus 10 according to this embodiment, the first-stage bending of the transported recording medium P is performed as the recording medium P abuts against the second deformation member 62, and the second-stage bending of the transported recording medium P is performed as the recording medium P abuts against the first deformation member 60. The amount of the second-stage bending is larger than the amount of the first-stage bending.

According to this configuration, the amount of the second-stage bending (by the first deformation member 60) is larger than the amount of the first-stage bending (by the second deformation member 62), and thus the amount of displacement (bending angle) of both of the side portions Ps of the recording medium P with respect to the central portion Pc is changed from a small displacement amount (small bending angle) to a large displacement amount (large bending angle).

In this manner, the displacement of both of the side portions Ps of the recording medium P with respect to the central portion Pc can be reasonably increased, and the flexibility can be reasonably strengthened. Accordingly, a force to curl the recording medium P can be resisted, and the curling of the recording medium P can be suppressed and prevented.

In the recording apparatus 10 according to this embodiment, the position 15 where the second deformation member 62 is in contact with the recording medium P is a position within 15 mm in the transport direction on an upstream side in the transport direction of the recording medium from the contact positions 70 of the discharge rollers 56.

A force inhibiting the transport of the recording medium P is generated in the recording medium P due to the deformation by the first deformation member 60 and the second deformation member 62. However, the position 15 of the second deformation member 62 is disposed at the position within 15 mm on an upstream side from the position 70 where the discharge roller 56 is in contact with the recording medium P. In other words, the distance between the second deformation member 62 and the discharge roller 56 in the transport path 11 is short.

In this manner, even when the force inhibiting the transport is generated in the transported recording medium P, the central portion Pc on the tip end side Pf abuts against the discharge roller 56 and is transported to a downstream side of the transport path 11 receiving the feeding force from the discharge roller 56 immediately after the tip end side Pf of the recording medium P is bent by the second deformation member 62. As a result, a reduction in transport speed of the recording medium P can be suppressed, and the possibility of jamming in the transport path 11 caused by a reduction in transport speed of the recording medium P and collision with the next or subsequent recording medium P can be reduced.

In the recording apparatus 10 according to this embodiment, at least the second deformation member 62 of the first bending member 58 is applied with the biasing force toward the transport path 11 and is retractable against the biasing force by the transported recording medium P.

According to this configuration, of the first deformation member 60 and the second deformation member 62, at least the second deformation member 62 is applied with the biasing force toward the transport path 11 and is retractable against the biasing force by the transported recording medium P. Accordingly, the second deformation member 62 can be disposed to abut against both of the side portions Ps of the transported recording medium P on the tip end side Pf with reliability and ease, and the bending of both of the side portions Ps of the recording medium P with respect to the central portion Pc can be performed with ease.

In the recording apparatus 10 according to this embodiment, the position 13 where the first deformation member 60 is in contact with the recording medium P is a position where the distance L2 from the contact position 70 of the discharge roller 56 is 80 mm or less in the width direction.

In this manner, the displacement can be made from a position closer to the central portion Pc of the recording medium P on the tip end side Pf, and the flexibility of the recording medium P can further be strengthened.

The discharge roller is configured to have a toothed roller.

In the recording apparatus 10 according to this embodiment, the shortest distance between the contact position 70 of the discharge roller 56 and the position where the second deformation member 62 is in contact with the outermost position of the recording medium P in the width direction is 120 mm or less.

In this manner, the flexibility of the recording medium P can be effectively strengthened in the transport direction of the recording medium P and in the width direction crossing the transport direction.

Also, the recording apparatus 10 according to this embodiment includes the recording unit 18 that performs recording on the recording surface Pr of the recording medium P, the discharge section 20 that discharges the recording medium P which is transported from the recording unit 18 along the transport path 11, the first bending member 58 that is in contact with the recording medium P which passes through the recording unit 18 in the transport path 11 and is transported toward the discharge section 20 to bend the recording medium P, and the second bending member 74 that is in contact with the recording medium P on a further downstream side in the transport direction than the contact position 70 of the discharge section 20 where the feeding force is applied to the recording medium P and maintains the bending shape of the recording medium P which is bent by the first bending member 58 as it is, and the second bending member 74 has mobility.

Herein, to "have mobility" means that the second bending member 74 is designed to be capable of moving in contact with the recording medium P, examples of which include rotating with a rotating shaft as a fulcrum, sliding about a moving shaft, and the second bending member 74 itself being bent and deformed. In other words, the "mobility" means that the second bending member 74 is designed in such a manner as to move while resisting a pressing force in a state of abutting against the transported recording medium P, receiving the pressing force resulting from the abutting from the recording medium P.

Again, the mobility may be obtained in abutting against the recording medium P. For example, a part of the second bending member 74 may be flexible and the second bending member 74 may be rotational. It is further preferable that at least a part of the member have flexibility and be rotational.

According to this configuration, the second bending member 74 has mobility, and thus the second bending member 74, when abutting against the recording medium P which is discharged from the discharge section 20, moves while resisting the pressing force in a state of abutting against the transported recording medium P, receiving the pressing force resulting from the abutting from the recording medium P. Accordingly, the second bending member 74 moves following the bending shape. In this manner, the shape bent by the second bending member 74 can be maintained as it is.

In a case where the second bending member 74 has flexibility, a part of the second bending member 74 is bent following the bending shape of the recording medium P which is bent by the first bending member 58 to be in surface contact with the recording medium P. Also, even in a case where a contact portion between the second bending member 74 and the recording medium P is formed into a protruding curved surface shape, the second bending member 74 is in surface contact with the recording medium P.

In this manner, the contact area between the second bending member 74 and the recording medium P is increased, and the second bending member 74 maintains the bending shape of the recording medium P by the surface contact. In other words, the holding force generated between the recording medium P and the second bending member 74 is larger than the force to return the bending shape of the recording medium P to a flat shape, and thus the shape bent by the first bending member 58 can be maintained as it is.

In the recording apparatus 10 according to this embodiment, the discharge section 20 has the discharge roller 56 that is positioned in the central portion of the transport path 11 in the width direction of the transported recording medium P, and the position 25 in contact with the recording medium P when the second bending member 74 holds the recording medium P is positioned on an outer side of the recording medium P in the width direction with respect to the contact position 70 of the discharge roller 56 where the feeding force is applied to the recording medium P and is positioned on the same position or on an inner side with respect to the contact position 13 when the first bending member 58 bends the recording medium P, and is positioned on a further downstream side in the transport direction of the recording medium than the contact position 70 of the discharge roller 56 in the transport direction of the recording medium P.

According to this configuration, the second bending member 74 abuts against the recording medium P at the position 25 and moves by itself, and thus the recording medium P can be biased in such a manner that the bending shape of the recording medium P is maintained.

Also, functionally, a plurality of the second bending members 74 are disposed in the width direction crossing the transport direction, but returning of the bending shape of the recording medium P to the flat state can be suppressed or prevented because of the abutting against the bent portion of the recording medium P for pinching from an outer side in the width direction. As a result, the second bending member 74 can suppress or prevent a tendency of curling of the recording medium P to the side opposite to the side bent by the first bending member 58.

Also, bending of the recording medium P can be gradually increased by the first bending member 58 and the second bending member 74, an increase in the transport resistance of the recording medium P generated by bending of the recording medium P in the transport direction can be suppressed, and thus a reduction in transport speed can be suppressed. In this manner, jamming in the transport path 11 generated by collision between the recording medium P whose transport speed is reduced and the subsequently transported recording medium P can be suppressed.

In the recording apparatus 10 according to this embodiment, the first bending member 58 is a rigid member. Herein, the "rigid member" is used to mean a member with a property contrary to "flexibility." However, the property contrary to "flexibility" does not strictly mean that the member is not bendable at all. Instead, in this specification, the "rigid member" means a member whose original shape is substantially maintained.

According to this configuration, the first bending member 58 can bend the recording medium P without being bent when abutting against the recording medium P. Also, the first bending member 58 is not bent when bending the recording medium P, and thus can resist a reaction force against the bending which is generated in the recording medium P when the recording medium P is bent and can maintain the bending shape thereof. Also, the recording medium P can be sent downstream in the bent state, and thus the flexibility of the recording medium P can be strengthened even in a state where the recording medium P is sent and separated from the nip positions 70 of the discharge rollers 56. Accordingly, the curling of the tip end side of the recording medium P on the axis of the width direction crossing the transport direction can be suppressed when the recording medium P is separated from the discharge rollers 56.

In particular, the first bending member 58 transfers the recording medium P to the second bending member 74 in a state where the recording medium P is bent, and thus it is necessary to bend the recording medium P as strongly as possible. If the bending is insufficient, a transport error may be caused during the transfer or the recording medium P may not be mounted appropriately on the mounting section 22 with the second bending member 74 not functioning as desired. Accordingly, it is preferable that a rigid member be used so that the bending is somewhat strong.

In the recording apparatus 10 according to this embodiment, the length of the convex-shaped section 78 in the transport direction is longer than the length of the recording medium P mounted on the mounting section 22 in the transport direction.

According to this configuration, the length of the convex-shaped section 78 in the transport direction is set to be longer than the length of the recording medium P, and thus the convex-shaped section 78 is in contact with the central portion Pc of the recording medium P bent in the transport direction over the entire length when the recording medium P is mounted. In this manner, the convex-shaped section 78 can inhibit the displacement of the central portion Pc of the recording medium P in the direction crossing the recording surface Pr even when the recording medium P which is mounted on the mounting section 22 is to return from the bending shape to the original flat state. Accordingly, the convex-shaped section 78 can maintain the bending shape of the recording medium P.

In this specification, "the recording medium that is discharged by the discharge roller" includes a recording medium which has a certain sheet size (for example, A3 size and A4 size).

Also, the recording apparatus 10 according to this embodiment includes the recording unit 18 that performs recording on the recording surface Pr of the recording medium P, the discharge section 20 that discharges the recording medium P which is transported from the recording unit 18 along the transport path 11, the first bending member 58 that is in contact with the recording medium P which passes through the recording unit 18 in the transport path 11 and is transported toward the discharge section 20 to bend the recording medium P, the second bending member 74 that is in contact with the recording medium P on a further downstream side in the transport direction than the contact position 70 where the feeding force is applied to the recording medium P in the discharge section 20 and maintains the bending shape of the recording medium P which is bent by the first bending member 58 as it is, the mounting section 22 where the recording medium P that is transported from the discharge section 20 is mounted, and the first biasing member 80 that is in contact with a surface on the rear end side in the transport direction of the recording medium P mounted on the mounting section 22 and on the side opposite to the recording surface Pr to perform biasing toward the recording surface Pr side on a further downstream side in the transport direction of the recording medium than the contact positions 70 of the discharge section 20, and the first biasing member 80 has mobility.

The mobility means that the first biasing member 80 may be configured to be capable of moving about the rotating shaft fulcrum or the first biasing member 80 may be configured to be capable of moving by sliding in the moving shaft. It is preferable that at least a part be configured as a flexible member because design at a low cost is possible. In a case where the first biasing member 80 is a rigid member capable of moving about the rotating shaft fulcrum or the first biasing member 80 is configured to be capable of moving by sliding in the moving shaft, the first biasing member 80 is disposed in a portion that can be touched by a user, but it is possible to prevent accidental damage to the first biasing member 80 caused by the user.

According to this configuration, the recording medium P that is discharged from the discharge section 20 to the mounting section 22 is in contact with the first biasing member 80, moves the first biasing member 80, and is transported to and mounted on the mounting section in a state of being bent or both thereof being performed. Accordingly, an elastic force is generated in the first biasing member 80 due to the movement or the bending, and the rear end side of the recording medium P in the transport direction is biased by the elastic force.

In this manner, the first biasing member 80, when in contact with the recording medium P that passes through the second bending member 74 and is transported, is moved following the bending shape of the recording medium P which is bent by the first bending member 58 and the second bending member 74, bending or both thereof are performed, and is in contact with the recording medium P.

Accordingly, the first biasing member 80 follows the bending shape, the contact between the first biasing member 80 and the recording medium P is stabilized, the first biasing member 80 maintains the bending shape of the recording medium P by the above-described contact, and the holding force inhibits the returning from the bending shape to the original flat shape. In this manner, the shape bent by the first bending member 58 can be maintained as it is in the recording medium P while the recording medium P is mounted on the mounting section 22. Further, a plurality of sheets of the recording medium P can be mounted appropriately on the mounting section 22.

Herein, the meaning of the second bending member 74 "maintaining the shape as it is" is not limited to completely maintaining the shape of the recording medium P bent by the first bending member 58 as it is. Instead, in a case where the bending shape is a U-shaped curl, the bending angle, the bending amount, and the like are allowed to be changed or, in a case where the bending shape is a wavy shape (cockling), wavy points, the number of waves, and the like are allowed to be changed. In other words, the meaning includes a change insofar as a significance of the shape of the recording medium P bent by the first bending member 58 is not lost.

Also, the "flexibility" that is an aspect of the mobility in this specification is different from a member rotating with the rotating shaft as a fulcrum, and means that the member itself is bent and deformed. In other words, the "flexibility" means being designed in such a manner that the shape thereof is deformed and bent in the direction of the pressing force while resisting the pressing force in a state of abutting against the transported recording medium P, receiving the pressing force resulting from the abutting from the recording medium P.

The recording apparatus 10 according to this embodiment includes the second biasing member 82 that is in contact with the surface on the tip end side Pf in the transport direction of the recording medium P mounted on the mounting section 22 and on the side opposite to the recording surface Pr to bias the recording medium P toward the recording surface Pr side on a further downstream side than the position of the first biasing member 80 in contact with the recording medium P, and the second biasing member 82 has mobility.

The mobility means that the second biasing member 82 may be configured to be capable of moving about the rotating shaft fulcrum or the second biasing member 82 may be configured to be capable of moving by sliding in the moving shaft. It is preferable that at least a part be configured as a flexible member because design at a low cost is possible. In a case where the second biasing member 82 is a rigid member capable of moving about the rotating shaft fulcrum or the second biasing member 82 is configured to be capable of moving by sliding in the moving shaft, the second biasing member 82 is disposed in a portion that can be touched by a user, but it is possible to prevent accidental damage to the second biasing member 82 caused by the user.

According to this configuration, the recording medium P that is discharged from the discharge section 20 is in contact with the second biasing member 82, moves the second biasing member 82, and is transported to and mounted on the mounting section 22 in a state of being bent or both thereof being performed. Accordingly, an elastic force is generated in the second biasing member 82 due to the movement and the bending, and the tip end side Pf of the recording medium P in the transport direction is biased by the elastic force.

In this manner, the second biasing member 82, when in contact with the recording medium P that passes through the second bending member 74 and the first biasing member 80 and is transported, is moved following the bending shape of the recording medium P which is bent by the first bending member 58 and the second bending member 74, bending or both thereof are performed, and is in contact with the recording medium P.

Further, the rear end side Pe of the recording medium P in the transport direction is biased by the first biasing member 80, and thus the shape of the recording medium P bent by the first bending member 58 can be maintained as it is by the first biasing member 80 and the second biasing member 82 while the recording medium P is mounted on the mounting section 22.

Accordingly, the curling of the recording medium P to the side opposite to the recording surface Pr can be suppressed or prevented. As a result, the recording medium P can be held in a state where the bending shape is maintained, and thus a plurality of sheets of the recording medium P can be stacked and mounted appropriately.

In the recording apparatus 10 according to this embodiment, the position of the first biasing member 80 that is in contact with the recording medium P is on an outer side than the position of the second biasing member 82 that is in contact with the recording medium P in the width direction of the mounting section 22 crossing the transport direction.

According to this configuration, the position of the first biasing member 80 biasing the rear end side Pe of the recording medium P that is in contact with the recording medium P is positioned on an outer side than the position of the second biasing member 82 that is in contact with the recording medium P. In the "outer side" arrangement, in a case where the recording medium P is curled along the transport direction (so-called vertical curl), curling may be initiated on the tip end side Pf if the length of the recording medium P in the transport direction is long even when the recording medium P is pressed by the first biasing member 80. However, it is preferable that the second biasing member 82 be arranged on an inner side than the first biasing member 80. It is preferable that the first biasing member 80 be arranged as close as possible to both of the end sides of the recording medium P so as to strongly suppress the curling of the recording medium P and the second biasing member 82 be positioned on an inner side than the first biasing member 80 so as to correspond to many types of recording media.

In the recording apparatus 10 according to this embodiment, the convex-shaped section 78 is disposed in the central portion of the mounting section 22 in the width direction of the recording medium P, and the convex-shaped section 78 corresponds to the shape of the recording medium P discharged from the discharge roller 56 which is bent by the first bending member 58.

Herein, to "correspond to the shape which is bent" means a configuration in which the bending shape can be maintained in contact in a fitted shape with the bending shape of the recording medium P. For example, a convex shape uniformly fitting to an inner portion of the U shape thereof corresponds to a case where the recording medium P is bent in a U shape along the transport direction.

According to this configuration, a shape maintaining function by the convex-shaped section 78 is added in addition to a shape maintaining function of the second biasing member 82, and the shape bent by the first bending member 58 can be further effectively maintained as it is.

In other words, when the recording medium P is mounted, the convex-shaped section 78 abuts against the central portion Pc of the recording medium P which is bent in the transport direction. In this manner, the convex-shaped section 78 acts to inhibit the displacement of the central portion Pc of the recording medium P in the direction crossing the recording surface Pr even when the recording medium P which is mounted on the mounting section 22 is to return from the bending shape to the original flat state. Accordingly, the convex-shaped section 78 can maintain the bending shape of the recording medium P.

According to this configuration, the tip end side Pf of the recording medium P and the convex-shaped section 78 are in contact with each other in the mounting section 22, and the recording medium P is sent to the mounting section 22 and is mounted by the discharge roller 56 in a state where the other portion of the recording medium P is not in contact with the convex-shaped section 78. In this case, the tip end side Pf of the recording medium P is transported while abutting against the convex-shaped section 78, and the frictional force is generated between the tip end side Pf and the convex-shaped section 78.

The frictional force acts in the direction opposite to the transport direction to press the tip end side Pf of the recording medium P to the convex-shaped section 78, and thus the curling of the tip end side Pf of the recording medium P to the side opposite to the recording surface Pr can be suppressed. In this manner, the convex-shaped section 78 can maintain the shape of the recording medium P bent by the first bending member 58 as it is with the second bending member 74.

In the recording apparatus 10 according to this embodiment, the first biasing member 80 is configured to be rotatable. According to this configuration, the first biasing member 80 is configured to be rotatable, and thus the first biasing member 80 abuts against the recording medium P and is rotated when the recording medium P is transported to the mounting section 22. Accordingly, the transport of the recording medium P toward the mounting section 22 is not hindered. Further, the first biasing member 80 returns from a rotating state to an original state when the recording medium P is mounted on the mounting section 22, and the recording medium P is biased from above the recording medium P. Accordingly, the first biasing member 80 can suppress or prevent the curling of the recording medium P to the side opposite to the recording surface Pr, that is, upward.

In the recording apparatus 10 according to this embodiment, the recording unit 18 has a line type recording head. An effect of the invention is significant when the invention is applied to a line printer with high recording speed.

Another Embodiment

Also, in this embodiment, the Fd discharge section 20 and the Fd mounting section 22 according to the invention are applied to an ink jet printer as an example of the recording apparatus, but also can be applied to other liquid ejecting apparatuses in general.

Herein, the liquid ejecting apparatuses are not limited to recording apparatuses such as printers, copiers, and fax machines, in which an ink jet type recording head is used and ink is discharged from the recording head to perform recording on a recording target medium, but include devices in which a liquid other than ink corresponding to an application thereof is ejected from a liquid ejecting head corresponding to the ink jet type recording head to an ejection target medium corresponding to the recording target medium and the liquid is attached to the ejection target medium.

Examples of the liquid ejecting head other than the recording head include a color material ejecting head that is used to manufacture color filters such as liquid crystal displays, an electrode material (conductive paste) ejecting head that is used to form electrodes such as organic EL displays and field emission displays (FED), a bio-organic material ejecting head that is used to manufacture biochips, and a sample ejecting head as a precision pipette.

The invention is not limited to the above-described embodiments, but various modifications are possible within the scope of the invention as set forth in the appended claims. As a matter of course, these are included within the scope of the invention.

What is claimed is:

1. A recording apparatus comprising:

a recording unit that performs recording on a recording surface of a recording medium;

a discharge section that discharges the recording medium which is transported from the recording unit along a transport path;

a first bending member that is in contact with the recording medium which passes through the recording unit in the transport path and is transported toward the discharge section to bend the recording medium so that the recording surface becomes an inner side;

a second bending member that is in contact with the recording medium on a further downstream side in a direction of the transport than a contact position of the discharge section where a feeding force is applied to the recording medium and bends the recording medium so that the recording surface becomes an inner side;

a mounting section where the recording medium that is discharged from the discharge section is mounted; and a convex-shaped section which is disposed in a central portion of the mounting section in a width direction of the recording medium;

wherein the recording medium which is discharged from the discharge section is mounted on the convex-shaped section and the recording medium which is mounted on the convex-shaped section is bent so that the recording surface becomes an inner side.

2. The recording apparatus according to claim 1, wherein the first bending member bends the recording medium in such a manner that the recording surface is directed inside by displacing both side portions with respect to a central portion of the recording medium in a width direction of the recording medium at a position on a further upstream side in the transport direction of the recording medium in the transport direction than the contact position of the discharge section where the feeding force is applied to the recording medium.

3. The recording apparatus according to claim 1, wherein the discharge section includes a discharge roller that is positioned in a central portion of the transport path in a width direction of the recording medium which is transported, wherein the first bending member includes:

a first deformation member that is in contact with the recording medium on an upstream side in the transport direction with respect to the contact position of the discharge roller where the feeding force is applied to the recording medium and at both outer side positions in the width direction with respect to the contact position of the discharge roller; and a second deformation member that is in contact with the recording medium on an upstream side in the transport direction with respect to a position of the first deformation member in contact with the recording medium and at both outer side positions in the width direction with respect to the contact position of the first deformation member, and wherein first-stage bending of the recording medium that is transported is performed as the recording medium abuts against the second deformation member and second-stage bending is performed as the recording medium abuts against the first deformation member, and an amount of the second-stage bending is larger than an amount of the first-stage bending.

4. The recording apparatus according to claim 1, wherein the recording unit includes a line type recording head.

5. The recording apparatus according to claim 1, further comprising a first biasing member that is in contact with a surface on a rear end side in the transport direction of the recording medium mounted on the mounting section and on a side opposite to the recording surface to perform biasing toward a recording surface side on a further downstream side in the transport direction of the recording medium than the contact position of the discharge section, wherein the first biasing member has mobility.

6. The recording apparatus according to claim 5, further comprising a second biasing member that is in contact with a surface on a tip end side in the transport direction of the recording medium mounted on the mounting section and on a side opposite to the recording surface to perform biasing toward the recording surface side on a further downstream side of a position of the first biasing member which is in contact with the recording medium, wherein the second biasing member has mobility.

7. The recording apparatus according to claim 6, wherein the position of the first biasing member that is in contact with the recording medium is on an outer side than the position of the second biasing member that is in contact with the recording medium in a width direction of the mounting section crossing the transport direction.

8. The recording apparatus according to claim 5, wherein the first biasing member is configured to be rotatable.

* * * * *